US005471822A

United States Patent [19]

Dugan et al.

[11] Patent Number: 5,471,822

[45] Date of Patent: Dec. 5, 1995

[54] APPARATUS AND METHOD FOR PACKAGING ARTICLES

[75] Inventors: Larry M. Dugan, Boulder; LeRoy J. Haverland, Arvada; Ronald L. Moore, Golden, all of Colo.

[73] Assignee: Coors Brewing Company, Golden, Colo.

[21] Appl. No.: 769,124

[22] Filed: Sep. 30, 1991

[51] Int. Cl.[6] ..... B65B 35/30; B65B 43/26

[52] U.S. Cl. ..... 53/532; 53/570; 53/258; 53/375.6; 53/385.1

[58] Field of Search ..... 53/147, 255, 258, 53/373.2, 375.6, 373.6, 443, 459, 469, 481, 532, 542, 568, 570, 384.1, 385.1

[56] References Cited

U.S. PATENT DOCUMENTS

| | | | |
|---|---|---|---|
| 1,505,404 | 8/1924 | Mitchell | 53/570 |
| 1,913,828 | 6/1933 | Brennan | 53/255 X |
| 3,340,679 | 9/1967 | Johnson | 53/385.1 |
| 3,597,895 | 8/1971 | Jensen | 53/385.1 X |
| 3,686,820 | 8/1972 | Zenger et al. . | |
| 3,732,665 | 5/1973 | Pitts | 53/258 X |
| 4,241,562 | 12/1980 | Meyer | 53/459 X |
| 4,251,977 | 2/1981 | Wakamatsu et al. | 53/443 |
| 4,664,161 | 5/1987 | Sawa et al. | 53/459 X |
| 4,776,149 | 10/1988 | Ter Horst . | |
| 4,848,059 | 7/1989 | Müller et al. . | |
| 4,956,964 | 9/1990 | Jones et al. | 53/384.1 X |
| 4,967,537 | 11/1990 | Moore . | |
| 5,058,364 | 10/1991 | Seiden et al. | 53/570 X |
| 5,095,680 | 3/1992 | Guardiola | 53/255 X |

FOREIGN PATENT DOCUMENTS

| | | | |
|---|---|---|---|
| 1090620 | 5/1984 | U.S.S.R. | 53/385.1 |

*Primary Examiner*—Linda Johnson

*Attorney, Agent, or Firm*—Klaas, Law, O'Meara & Malkin

[57] ABSTRACT

Apparatus and method for packaging articles, such as container ends, using a product having a plurality of interconnected compartments formed in two continuous superposed sheets by a lengthwise extending seam and a plurality of spaced apart widthwise extending seams so that each compartment has one open end, by moving one of the compartments to a predetermined location, gripping the widthwise extending seams of the one compartment, moving one of the gripped seams toward the other of the gripped seams, applying a force to the open end to move apart the portions of the superposed strips forming the one compartment, holding a plurality of articles at a location aligned with the open end, pushing the articles into the one compartment, at least partially closing the open end to form a partially closed compartment having articles confined therein, moving the partially closed compartment to move another compartment into the predetermined location and repeating the process to form a plurality of interconnected partially closed compartments each having a plurality of articles confined therein. The interconnected partially closed compartments may be severed along the widthwise extending seams to form a plurality of separate partially closed compartments or may remain interconnected and be palletized. Mounting apparatus for mounting a rodless cylinder is also provided.

52 Claims, 13 Drawing Sheets

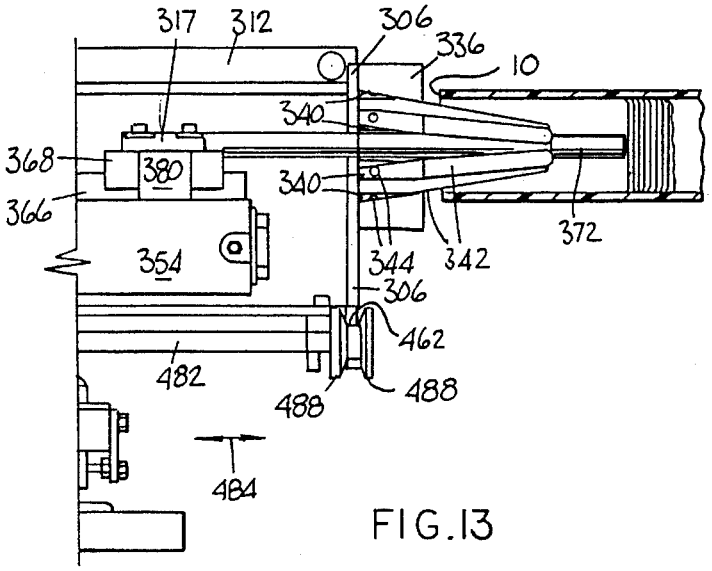
FIG.13
FIG.15
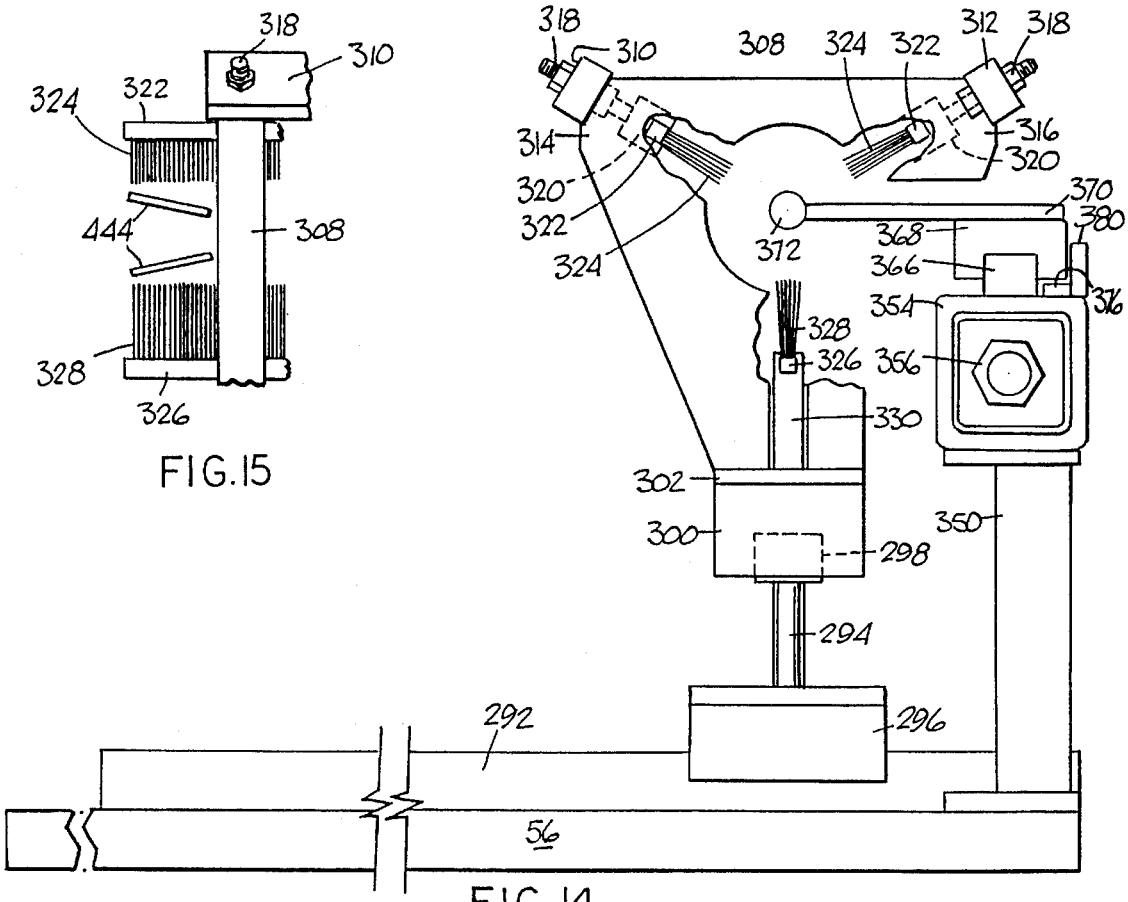
FIG.14

APPARATUS AND METHOD FOR PACKAGING ARTICLES

FIELD OF THE INVENTION

This invention relates generally to the field of packaging and more specifically to the automated packaging of a plurality of articles having a uniform perimeter and a relatively small axial extent, such as ends of beverage containers.

BACKGROUND OF THE INVENTION

In the manufacture of containers, such as aluminum soft drink and beer cans, the tops or ends of the cans are manufactured in a stamping and scoring operation in a conversion press, where they are provided with beaded rims, "pop-tops", and so forth. The generally flat disc ends are then stacked face-to-face and packaged in paper bags. The bags facilitate transport and handling of the ends and protect them from dirt and other contaminants. The bags are fabricated from a one piece sheet of light weight paper material by joining opposite sides of the sheet to form an elongated tube large enough to enclose the stack of can ends. The bottom of the sheet is folded to form a flap extending radially outwardly from the stack and the top of the wrapper is folded to form a pair of ears extending longitudinally upwardly and radially outwardly from the stack. The wrapped end packages are transported to a sensor apparatus where the ends are joined to filled beverage containers.

In U.S. Pat. No. 3,686,820 to Zenger et al., there is disclosed a system for packaging ends for beverage containers wherein a plurality of ends are in sealed compartments which are in sealed compartments which are interconnected. Zenger et al. employ two continuous strips of a plastic film which are heat sealed around a plurality of ends so that the sealed compartments are gas impervious. In many instances, the container ends are coated with a material during their manufacture and it is desirable to have air contact with the container ends after they have been packaged so as to allow volatile portions of the coating to escape from the paper tube.

In U.S. Pat. No. 4,967,537 to Moore, there is disclosed another system for packaging ends for beverage containers which results in a plurality of ends in sealed compartments. In Moore, one of the superposed sheets is a kraft paper having a thermally reactive adhesive material as its inner surface and the other comprises a kraft paper which permits passage of gaseous materials, such as air or airborne solvents.

BRIEF DESCRIPTION OF THE INVENTION

This invention provides apparatus and method for packaging articles, such as relatively flat circular objects, such as ends for beverage containers wherein a product comprising a plurality of interconnected compartments, each having one open end, is moved through the apparatus so that a plurality of articles may be positioned in each of the open ended compartments and afterward at least partially closing the open end to form a plurality of interconnected at least partially closed compartments having the articles confined therein and preferably the partially closed compartments are separated to form a plurality of individual partially closed compartments having the articles confined therein. The invention also provides a transfer system for transferring the articles from an accumulating station to a location at which the articles are positioned in an open ended compartment. The invention also provides mounting means for mounting a rodless cylinder to increase the amount of force that it can place on a workpiece.

In a preferred embodiment of the invention, a product for use in packaging articles, such as relatively flat circular objects, such as ends for beverage containers, is provided. The product comprises at least two superposed continuous strips of a flexible material having opposite edge portions defining the width of the at least two superposed continuous strips. First joining means join together portions of the at least two superposed continuous strips extending in a lengthwise direction and are located adjacent to one of the opposite edge portions. A plurality of spaced apart second joining means join together superposed portions of the at least two superposed continuous strips and extend in a widthwise direction. Each of the second joining means have one end portion joined with a portion of the first joining means and have the other end thereof terminating at a location spaced from the other of the opposite end portions to form a plurality of compartments, each having one open end. Each of the open ended compartments has a lengthwise extent extending between the centerlines of two successive second joining means. Rupturable joining means for joining together superposed portions of the at least two superposed sheets are in each of the open ended compartments and are located adjacent to but spaced from the portion of the first joining means in each of the open ended compartments. The portion of the second joining means located between the rupturable joining means and the portion of the first joining means in each of the open ended compartments has a lengthwise extent greater than the lengthwise extent of the other portion of the second joining means. The flexible material is air pervious.

The apparatus for inserting a plurality of articles, such as relatively flat, circular objects, such as ends for containers, into the above-described compartments having one open end comprises a bed plate mounted on a frame supported at a relatively fixed location. Moving means are provided for moving the plurality of interconnected compartments, each having one open end, through the apparatus. The apparatus mounted on the bed plate includes opening means for moving the portions of the at least two superposed sheets of at least one of the open ended compartments in opposite directions to form a generally circular opening therein; transfer means for moving a plurality of articles through the generally circular opening and into the at least one of the open ended compartments; closing means for at least partially closing the portions of the at least two superposed sheets adjacent to the generally circular opening to form at least a partially closed compartment having the plurality of articles contained therein; holding means for holding at least one of the at least partially closed compartments; moving means for moving the at least one partially closed compartment to form a plurality of interconnected partially closed compartments; severing means for severing the widthwise extending joining means to form one separated partially closed compartment and accumulating means for accumulating the separated at least partially closed compartments.

The opening means comprises support means, slidably mounted on the bed plate and first reciprocating means for reciprocating the support means in generally horizontal linear directions. Clamping means are mounted on the support means for movement therewith and at least one portion of the clamping means is moved to apply a clamping force on at least a portion of at least one of the widthwise joining means located between the clamping means. Blowing means are mounted on the support means for movement therewith and relative thereto and function to blow a stream of air into the one of the open ended compartments located in the first work station to move, at least partially, the superposed sheets of an open ended compartment. While the blowing means are presently preferred, other opening means, such as expandable fingers or a plunger, can be used. Second reciprocating means are provided for reciprocating the blowing means in linear directions relative to the support means. Mounting means are provided for mounting the closing means on the bed plate so that the open end portion of an open ended compartment may be located therebetween.

A plurality of spaced apart accumulating means are provided, each of which accumulates a predetermined number of the articles. The plurality of accumulating means have parallel longitudinal axes. Each of the plurality of accumulating means has discharging means for discharging the accumulated articles from each of the plurality of accumulating means. Transfer means are provided for receiving and holding the discharged articles from each of the accumulating means and have a longitudinal axis which coincides with the longitudinal axis of each of the accumulating means when the accumulated articles are being moved into the transfer means. The transfer means have a generally circular opening facing the accumulating means so that articles may be moved from the accumulating means into the transfer means. Guide means are provided for guiding the movement of the articles from the accumulating means into the transfer means. The guide means comprise a plurality of flexible resilient fingers, each having one end thereof secured to the accumulating means and the other end thereof free to be moved. The other ends are normally in a relatively close relationship to ensure the passing thereof into the generally circular opening of the transfer means. The plurality of flexible resilient fingers apply a force on the articles as they pass through the guide means to ensure that the articles remain in a desired relationship as they are moved from the accumulating means into the transfer means.

The transfer means comprise a pair of spaced apart support brackets and at least a pair of support bars extending between and secured to the support brackets. Holding means are provided for supporting the articles and maintaining them in upright positions as they are moved into and out of the transfer means. The holding means comprise a plurality of circumferentially spaced apart brushes with at least two of the brushes adjustably mounted for adjustment in radial directions. Moving means are provided for moving the transfer means having articles confined therein between locations adjacent to the accumulating means and the location at which the articles are moved out of the transfer means and into one of the open ended compartments. The moving means comprise at least a pair of spaced apart guide rails mounted on the bed plate; at least one bearing slide mounted for sliding movement over each of the at least a pair of spaced apart guide rails; support means mounted on the bearing slides for supporting the transfer means and drive means for moving the moving means. A plurality of stop means are mounted on the bed plate for stopping the movement of the transfer means at desired locations for transferring the articles from the accumulating means to the transfer means and from the transfer means through the generally circular opening and into the open ended compartment.

Force applying means are provided for applying a force on the articles in the transfer means to move the articles out of the transfer means and into one of the open ended compartments. The force applying means comprise a rodless cylinder comprising a hollow cylindrical shaft and a piston slidably mounted therein. An external yoke is mounted for sliding movement over the rodless cylinder and is magnetically coupled to the piston for movement therewith. Mounting means are provided for mounting the rodless cylinder and the external yoke on the support bars. A tool is mounted on a portion of the yoke and is located to contact at least the end one of the articles in the transfer means. The mounting means comprise a relatively rigid generally tubular support having opposite end portions and a longitudinal axis; support means at each of the opposite end portions for supporting the rodless cylinder; an external guide rail mounted on the relatively rigid generally tubular support; slidable bearing means mounted on the external guide rail for sliding movement thereover; coupling means for coupling the slidable bearing means and the external external yoke so that movement of the external yoke moves the slidable bearing means and a work performing tool mounted on the slidable bearing means for movement therewith so that forces applied to the work performing tool will be absorbed by the slidable bearing means, the guide rail and the relatively generally tubular support. The relatively rigid generally tubular support has a longitudinally extending slot formed therein; and at least a portion of the coupling means extends through the longitudinally extending slot. The coupling means comprise a bracket mounted on the external external yoke and located so that at least a portion thereof extends through the longitudinally extending slot; a plate member mounted on the slidable bearing means and connecting means for connecting the bracket and the plate member together so that the plate member moves with the bracket. The connecting means preferably comprise at least one weld. A first extension member extends from one of the opposite end portions of the rodless cylinder. An end cover is provided and has a circular hole extending therethrough. The first extension member passes through the circular hole and has at least a portion thereof projecting outwardly from the end cover. First securing means are provided for securing the end cover on the one of the opposite end portions of the rodless cylinder. A support member is provided and has a transverse cross-sectional configuration slightly smaller than the transverse cross-sectional configuration of the relatively rigid hollow support tube so that the support member may be moved into the relatively rigid hollow support tube. The support member has a circular hole extending therethrough. A second extension member extends from the other of the opposite end portions of the rodless cylinder. The second extension member passes through the circular hole and has at least a portion thereof projecting outwardly from the support member. Second securing means are provided for securing the support member to the relatively rigid generally tubular support with at least portions of the end cover in contact with one of the opposite end portions of the relatively rigid generally tubular support. Mounting means are provided for mounting the other end portion of the rodless cylinder on the support member to permit movement of the other end portion of the rodless cylinder generally in radial directions relative to the support member.

The holding means comprise upper holding means having a longitudinally extending arcuate surface adapted to be moved into contact with a top portion of a partially closed compartment. First vertical reciprocating means are provided for reciprocating the upper holding means between an opened and a closed position and lower holding means having a longitudinally extending arcuate surface for forming a cradle to support a partially closed compartment.

Second vertical reciprocating means are provided for reciprocating the lower holding means between an opened and a closed position. Reciprocating means are for reciprocating the upper and lower holding means between locations whereat a partially closed container is removed from the holding means and whereat the holding means are positioned around a partially closed compartment. The lower holding means has a plurality of spaced apart slots formed therein and a plurality of fixed support fingers are located in alignment with the slots for supporting at least one of the at least partially closed compartments. The arcuate surface of the lowermost holding means has a lowermost portion and each of the support fingers has a top surface and the support fingers are located so that the top surfaces are slightly below the lowermost portion. The reciprocating means comprise at least a pair of spaced apart guide rails mounted on the bed plate and slide members mounted on the guide rails for sliding movement thereover. A support member extends between and is secured to the slide members. The second vertical reciprocating means are mounted on the support member for movement therewith. The first vertical reciprocating means are mounted for movement with the second vertical reciprocating means.

The severing apparatus comprises a rotatable knife moving over a support means. Mounting means are provided for mounting the rotatable knife for movement in reciprocating linear directions. Drive means are provided for reciprocating the rotatable knife. Positioning means are provided for positioning a widthwise extending joining means relative to the rotatable knife so that the rotatable knife will contact the centerline of the widthwise extending joining means to sever the widthwise extending joining means and the associated portion of the lengthwise extending joining means to separate one of the partially closed compartments. Support means are provided for supporting the widthwise extending joining means and the associated portion of the lengthwise extending joining means to cooperate with the rotatable knife in the separation of the one of the partially closed compartments. The positioning means comprise a first inclined surface for supporting one of the partially closed compartments so that a force is applied to the one of the partially closed compartments tending to move it in one direction and a second inclined surface for supporting another one of the partially closed compartments so that a force is applied to the another one and the one of the partially closed compartments tending to move them in the same one direction. Mounting means are provided for mounting the second inclined surface and the support means for movement in reciprocating linear directions between a severing location and a non-severing location. Conveyor means are provided for removing the severed another one of the partially closed compartments and conveying it to an accumulating location.

In another preferred embodiment of the invention, the interconnected partially closed compartments are palletized instead of being severed.

BRIEF DESCRIPTION OF THE DRAWINGS

Illustrative and presently preferred embodiments of the invention are shown in the accompanying drawings in which:

FIG. 13 is an end elevational view of a portion of FIG. 11 after it has been moved;

FIG. 14 is a side elevational view taken from the left side of FIG. 11;

FIG. 15 is an elevational view of a portion of FIG. 14 and a portion of FIG. 19;

DETAILED DESCRIPTION OF THE INVENTION

Figure 1:
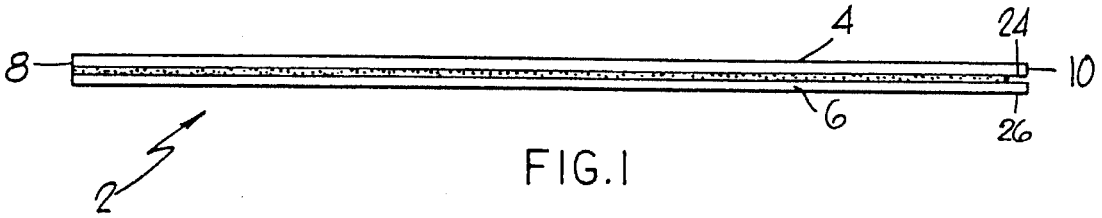
FIG. 1 is an end elevational view of a product for use with this invention.
Figure 2:
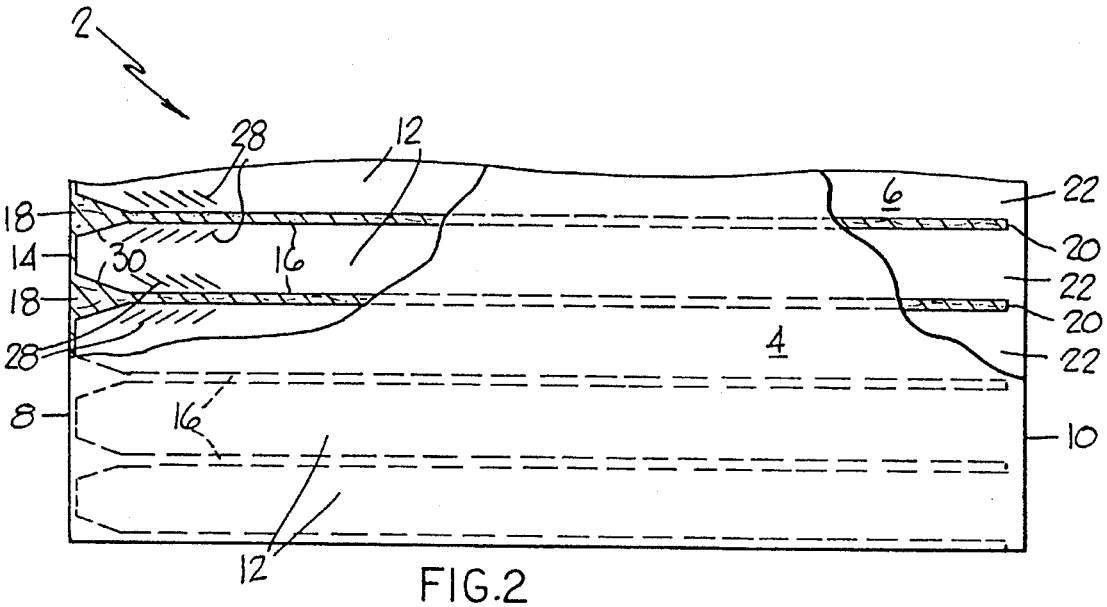
FIG. 2 is a top plan view with parts broken away of a portion of the product of FIG. 1.

In FIGS. 1 and 2, there is illustrated a product 2 of this invention. The product 2 comprises superposed continuous strips 4 and 6 of a flexible material, such as a gas pervious kraft paper, and having opposite edge portions 8 and 10. A plurality of compartments 12 are formed between the superposed strips 4 and 6 by joining together portions of the superposed strips 4 and 6 by suitable means, such as an adhesive material. A substantially continuous seam 14 of adhesive extends in a lengthwise direction along the edge portion 8 and a plurality of spaced apart seams 16 of adhesive extend in a widthwise direction and have end portions 18 in common relationship with a portion of the continuous seam 14 and other end portions 20 which terminate a short distance from the other opposite edge portion 10 so as to form the compartments 12 each having one open end 22. This also provides free end portions 24 and 26 on the superposed strips 4 and 6 for purposes described below. A plurality of spaced apart bars 28 of adhesive join together portions of the superposed strips 4 and 6 for purposes described below. Also, portions 30 of the seam 16 in each compartment 12 between the spots 28 and the one end portion 18 converge toward each other for purposes described below.

The apparatus 40 illustrated in FIGS. 3–7 has a roll 44 of the product 2 which is rotatably mounted on a support 46 so that a continuous strip 48 may be removed therefrom. Tensioning means 50 are provided for maintaining the proper tension on the continuous strip 48. Guide rolls 52 are provided for guiding the continuous strip 48 into a guide and support means 54. A bed plate 56 for supporting the apparatus of this invention is mounted on a plurality of spaced apart supports 58 which are in contact with the floor 60 of a building. The bed plate 56 can comprise one unit or several units.

Figure 4:
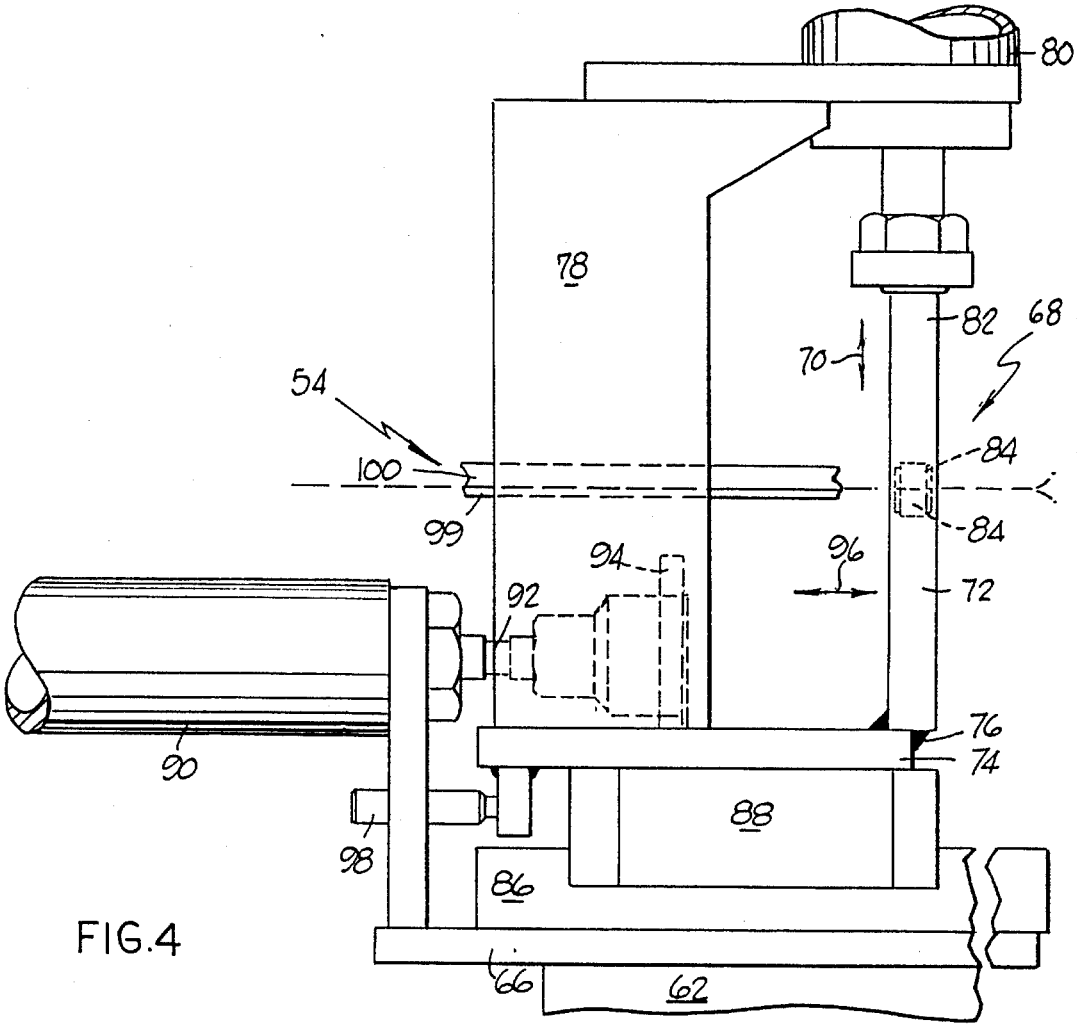
FIG. 4 is a side elevational view of a portion of FIG. 3 with parts removed.
Figure 5:
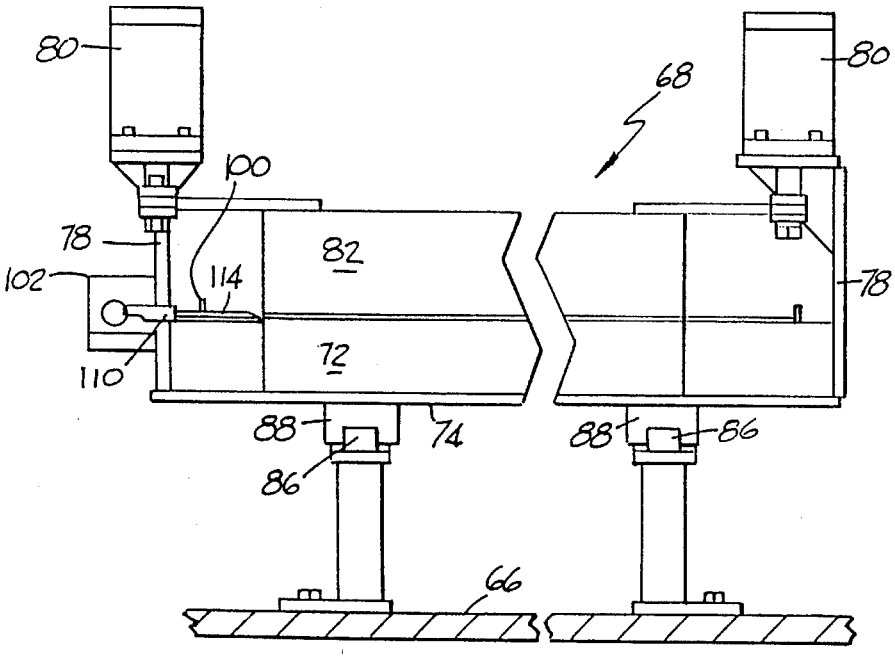
FIG. 5 is a cross-sectional view with parts removed taken on the line 5—5 of FIG. 3.

A pair of spaced apart L-shaped support plates 62 are mounted on the bed plate 56 by bolts 64. A support plate 66, FIG. 4, extends between the L-shaped support plates 62 and is connected thereto by suitable means, such as by welding. Clamping means 68 are mounted so that at least one portion thereof has reciprocal linear movement in the directions indicated by the arrow 70. The clamping means 68 comprises a lower clamping member 72 mounted on a support plate 74 by suitable means, such as by welding 76. A pair of spaced apart vertically extending support means 78, FIG. 5, are mounted on the support plate 74 by suitable means, such as by welding (not shown). An air cylinder 80 is mounted on each of the support means 78. An upper clamping member 82 is mounted on the air cylinders 80 to be moved in vertical directions toward or away from the lower clamping member 72. Resilient clamping means 84 are mounted in facing portions of the lower and upper clamping members 72 and 82. A pair of spaced apart slide guides 86 are fixedly mounted on the support plate 66 and a pair of spaced apart bearing slides 88 are secured on the bottom surface of the support plate 74. The slide guides 86 and the bearing slides 88 are conventional, such as the type marketed by THK Co. Ltd. under the trade designation SR-W/SR-V. At least one air cylinder 90 is mounted at a fixed location on the support plate 66 and the piston rod 92 thereof is connected to a block 94 secured to the support plate 74 by suitable means, such as by welding, so that the air cylinder 90 moves the support plate 74 over the slide guides 86 in the directions indicated by the arrow 96. At least one adjustable stop member 98 limits the movement of the support plate 74. As illustrated in FIG. 4, the guide and support means 54 comprises a base support plate 99 and opposite guide flanges 100.

Figure 3:
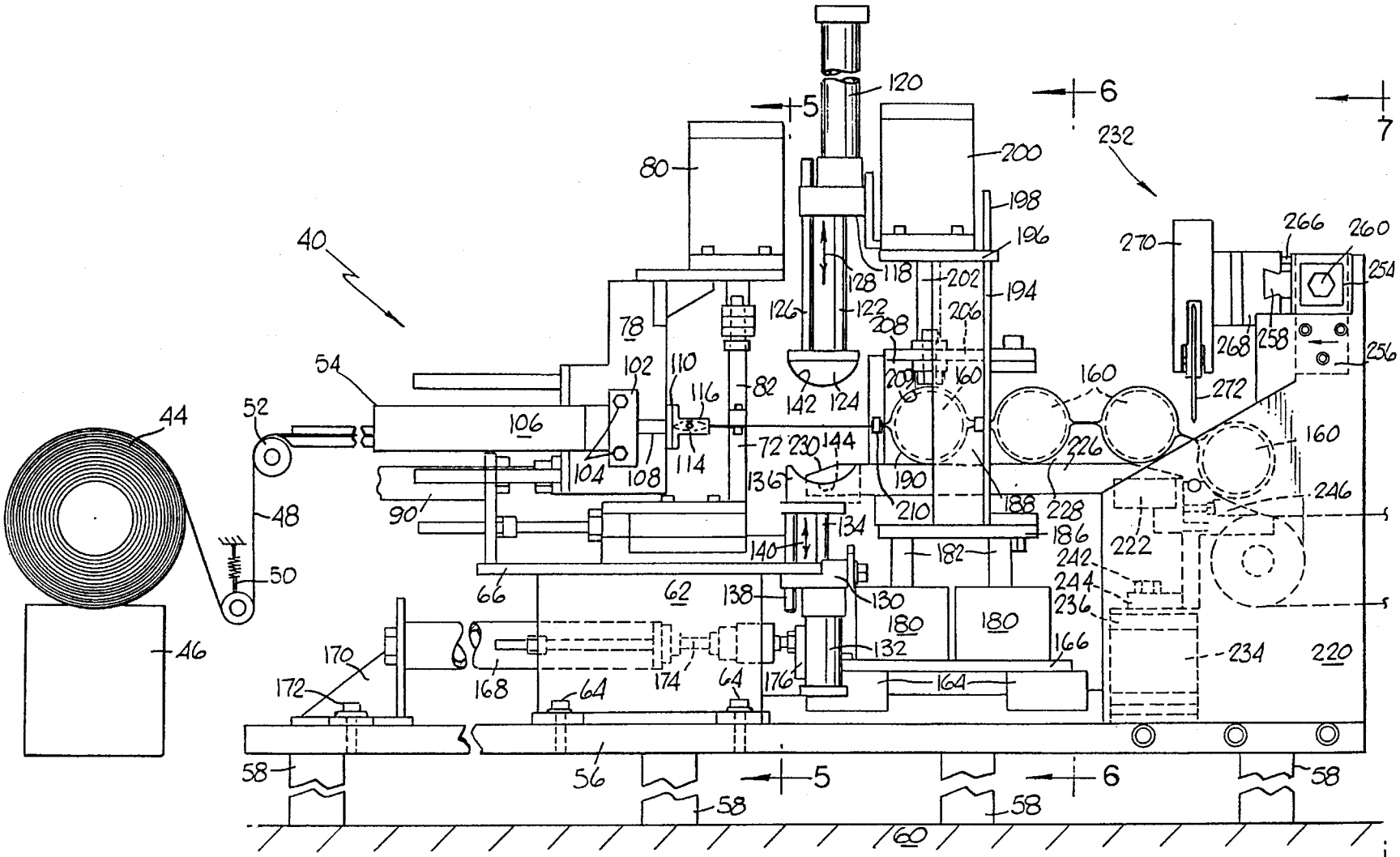
FIG. 3 is a side elevational view of a portion of the apparatus of this invention.

The main body portion 102, FIG. 3, of a powered slide, such as that marketed by PHD Incorporated under the trade designation phd is secured by headed threaded bolts 104 on the support means 78 for movement therewith. A cylinder 106 reciprocates a piston rod 108 in linear directions. A support member 110 is mounted on the end of the piston rod 108 for movement therewith. An air nozzle 114 is mounted on the support member 110 and is secured within an elliptically shaped external yoke 116, FIGS. 21–23, so that the free end portions 24 and 26 may slide over the elliptically shaped external yoke 116 to expose the open ends 22 of the compartments 12.

An upper support bracket 118, FIG. 3, has an air cylinder 120 mounted thereon. The air cylinder 120 has a reciprocating piston rod 122 on which is mounted a crushing head 124 for purposes described below. A guide rod 126 passes through the support bracket 118 and is secured to the crushing head 124 to guide the movement thereof in the directions indicated by the arrow 128. A lower support bracket 130 has an air cylinder 132 mounted thereon. The air cylinder 132 has a reciprocating piston rod 134 on which is mounted a crushing head 136 for purposes described below. A guide rod 138 passes through the lower support bracket 130 and is secured to the crushing head 136 to guide the movement of the crushing head 136 in the directions indicated by the arrow 140. The crushing head 124 has a convex surface 142 and the crushing head 136 has a concave surface 144. Other means may be substituted for the crushing heads 124 and 136 and may be located at a different location.

Figure 6:
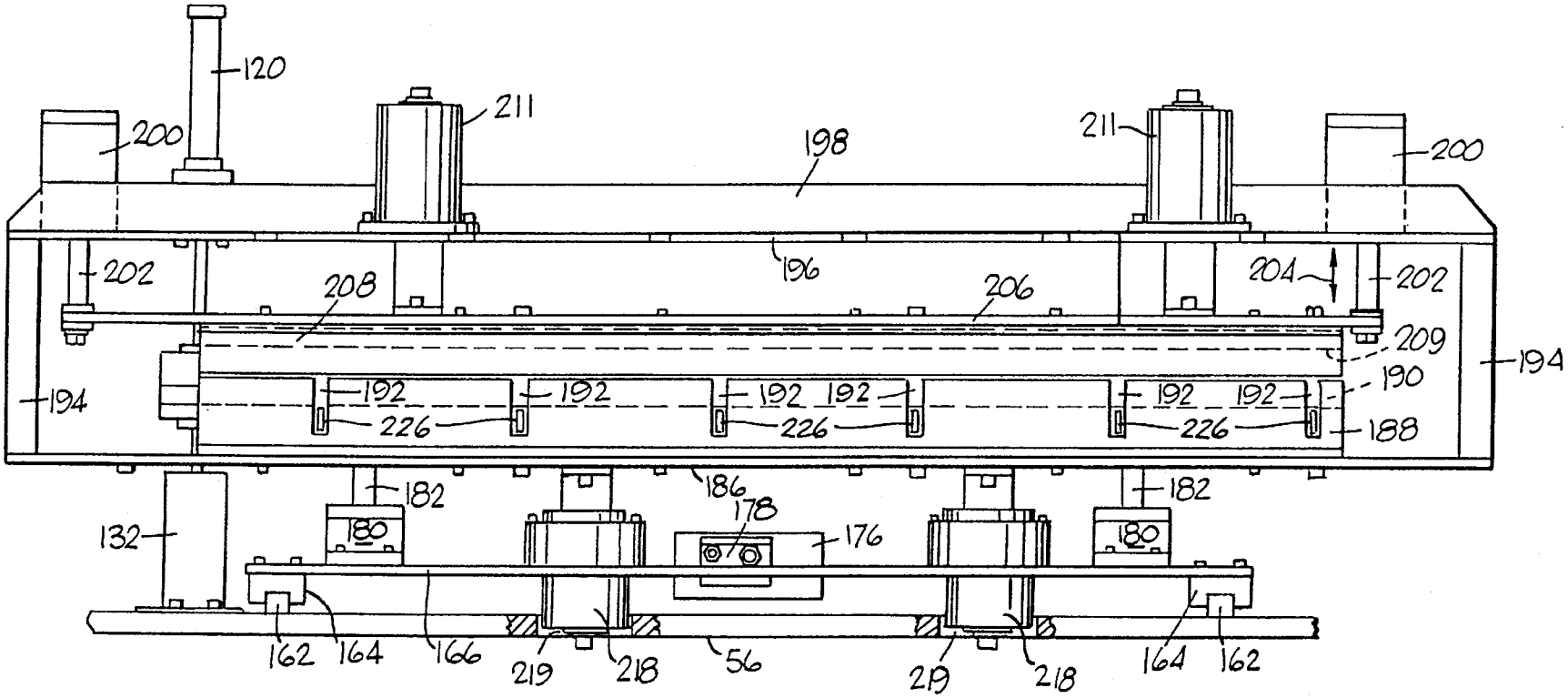
FIG. 6 is an elevational view with parts removed taken on the line 6—6 of FIG. 3.

In FIGS. 3 and 6, there is illustrated the section of the apparatus 40 for moving the continuous strip 48 before and after the container ends 160 have been inserted into one of the compartments 12. A pair of spaced apart guide rails 162, similar to the guide rails 86, are mounted on the bed plate 56 and a pair of bearing slides 164, similar to the bearing slides 88, are mounted for sliding movement over the guide rails 162. There are two bearing slides 164 on the left side of FIG. 6 and one bearing slide 164 on the right side of FIG. 6. A support plate 166 extends between and is mounted on the bearing slides 164 for movement therewith. An air cylinder 168 is mounted on a support bracket 170 secured to the bed plate 56 by headed threaded bolts 172. The piston rod 174 of the air cylinder 168 is connected to a bracket 176 which is secured to the support plate 166 by the bracket 178 so that movement of the piston rod 174 moves the support plate 166 over the guide rails 162.

Figure 6A:
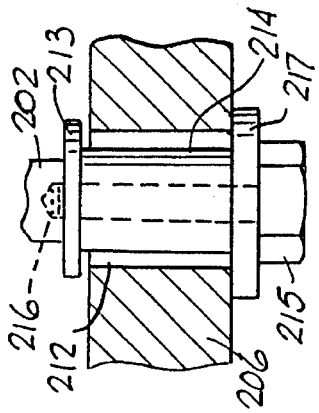
FIG. 6A is an enlarged portion of FIG. 6.

Four air cylinders 180 are mounted on the support plate 166 and have piston rods 182 which reciprocate in vertical directions as indicated by the arrow 184. A support plate 186 is mounted on the piston rods 182 for movement therewith. Lower holding means 188 are mounted on the support plate 186 for movement therewith and have a longitudinally extending arcuate surface 190 formed therein. A plurality of transversely extending slots 192 are formed in the lower holding means 188. A pair of spaced apart support members 194 extend upwardly from the support plate 186 and a support plate 196 extends between and is secured to the support members 194. A reinforcing bar 198 is secured to the support plate 196. Two spaced apart air cylinders 200 are mounted on the support plate 196 and have reciprocating piston rods 202 that reciprocate in the direction indicated by the arrow 204. A support plate 206 extends between and is connected to the piston rods 202 for movement therewith. An upper holding means 208 is secured to the support plate 206 for movement therewith and has a longitudinally extending semi-circular recess 209 formed therein. The lower and upper holding means 188 and 208 are provided with clamping means 210 to clamp a seam 16 therebetween. As illustrated in FIG. 3, the recesses 190 and 210 accommodate a compartment 12 having container ends 160 therein. A pair of spaced apart guide bearings 211 are mounted on the support plate 196 and connected to the support plate 206 to guide the movement of the support plate 206. As illustrated in FIG. 6A, the piston rods 202 are connected to the support plate 206 so as to have a loose fit. An opening 212 is formed in the support plate 206. A flange portion 213 is formed on the end of the piston rod 202 and has a diameter greater than the diameter of the opening 212. A hollow spacer element 214 is located in the opening 212 and has an axial extent greater than the axial extent of the opening 212. A headed threaded bolt 215 passes through the hollow spacer element 214 and is threaded into a threaded opening 216 in the end of the piston rod 202. A washer 217 is located between the head portion of the headed threaded bolt 215 and the hollow spacer element 214 and has a diameter greater than the diameter of the opening 212. When the headed threaded bolt 215 is tightened, the hollow spacer element 214 holds the flange portion 213 and the washer 217 spaced apart a distance to permit movement of the flange portion 213 and the washer 217 relative to the support plate 206. A pair of spaced apart guide bushings 218 are mounted on the support plate 166 and are connected to the support plate 186 to guide the movement of the support plate 186. The lower portions of the guide bushings 218 are located in elongated openings 219 in the support plate 56 to provide for movement of the support plate 166 over the guide rails 162. If desired, the piston rods 182 may be connected to the support plate 186 in the same manner as the piston rods 202 are connected to the support plate 206.

Figure 7:
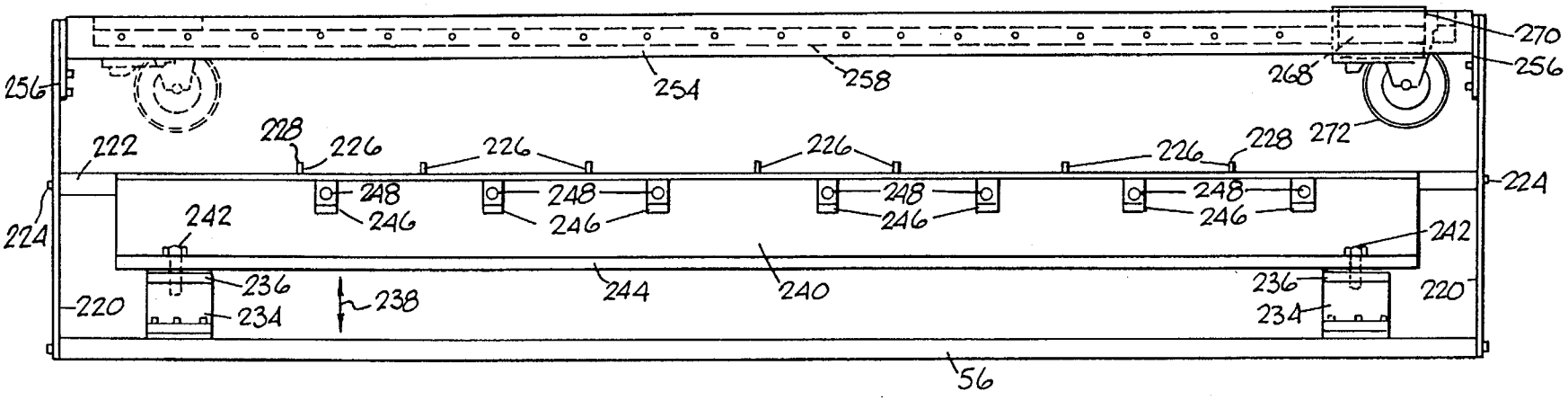
FIG. 7 is an elevational view with parts removed taken on the line 7—7 of FIG. 3.
Figure 8:
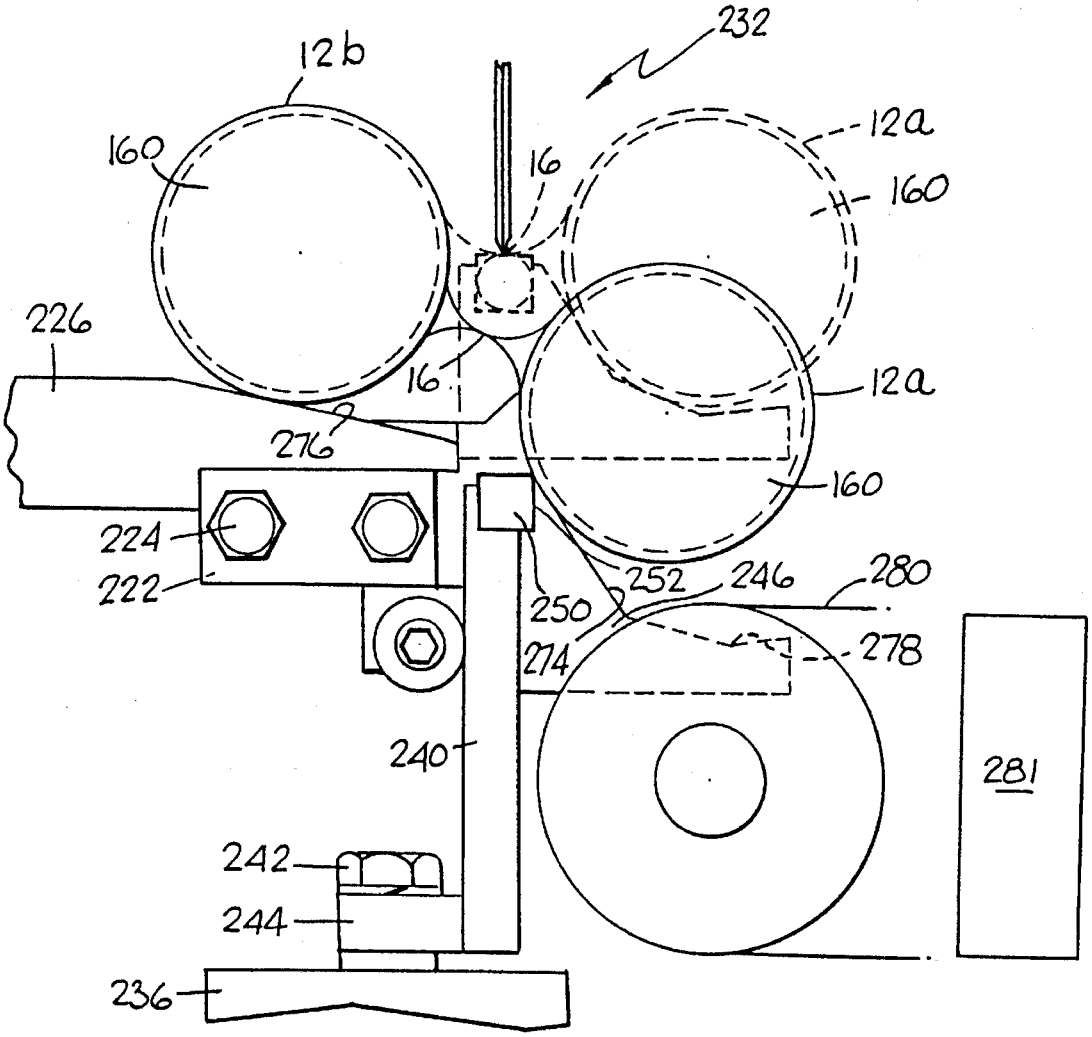
FIG. 8 is an enlarged end view of a portion of FIG. 3.

A pair of spaced apart upwardly extending support members 220, FIGS. 7 and 8, are mounted on the bed plate 56. A support beam 222 extends between and is secured to the support members 220 by headed threaded bolts 224. A plurality of spaced apart support bars 226 extend outwardly and perpendicularly to the support beam 222 and are secured thereto by suitable means, such as by welding (not shown). The support bars 226 have an upper surface 228 for supporting the compartments 12 having the container ends 160 therein. The support bars 226 have end portions 230 adjacent to the crushing heads 124 and 136.

Cutting apparatus 232 is illustrated in FIGS. 3, 7 and 8. Two air cylinders 234 are mounted on the bed plate 56 and have reciprocating piston rods 236 which reciprocate in the directions indicated by the arrow 238. A support member 240 extends between and is mounted on the piston rods 236 by headed threaded bolts 242 extending through openings (not shown) in a flange 244 on the support member 240. A plurality of cradles 246 for holding a compartment 12 having container ends 160 therein are mounted on the support member 240 using headed bolts 248. A recess 250 is formed at the top of the support member 240 and the cradles 246 and a cutting support bar 252 is mounted therein and extends for the full length of the support member 240. A support tube 254 extends between and is mounted on the support members 220 by mounting bracket 256. A guide rail 258, similar to the guide rails 86, is mounted on the support tube 254. A rodless cylinder 260, such as that marketed by FESTO under the trade designation DGO, is mounted, as described below, in the support tube 254. Coupling means 266 connect a bearing slide 268 to the rodless cylinder 260 so that the bearing slide 268 is moved over the guide rail 258. A cutter assembly 270 having a rotatable knife blade 272 is mounted on the bearing slide 268.

The operation of the cutting apparatus 232 is illustrated in FIG. 8 wherein the cutting apparatus 232 in the non-cutting position is illustrated by the solid lines and in the cutting position by the dashed lines. In the non-cutting position, a first partially closed compartment **12*a* having container ends 160 therein is in contact with the inclined surface 274 of each cradle 246 and a second partially closed compartment 12*b* having container ends 160 therein is seated on the inclined surface 276 of the support bars 226. When the piston rods 236 are moved upwardly, the holding surface 278 of the cradle 246 contacts the compartment 12*a* and moves it upwardly. At the same time, the cutting support bar 252 contacts the seam 16. The bearing slide 268 is then moved from the solid line position in FIG. 7 to the dotted line position in FIG. 7. During the movement of the bearing slide 268, the knife blade 272 and the cutting support bar 252 cooperate to cut the seam 16 between the partially closed compartments 12*a* and 12*b*. The piston rods 236 are then moved downwardly and the severed compartment 12*a* is deposited on the movable conveyor 280 to be conveyed to a palletizing station (281**).

Figure 9:
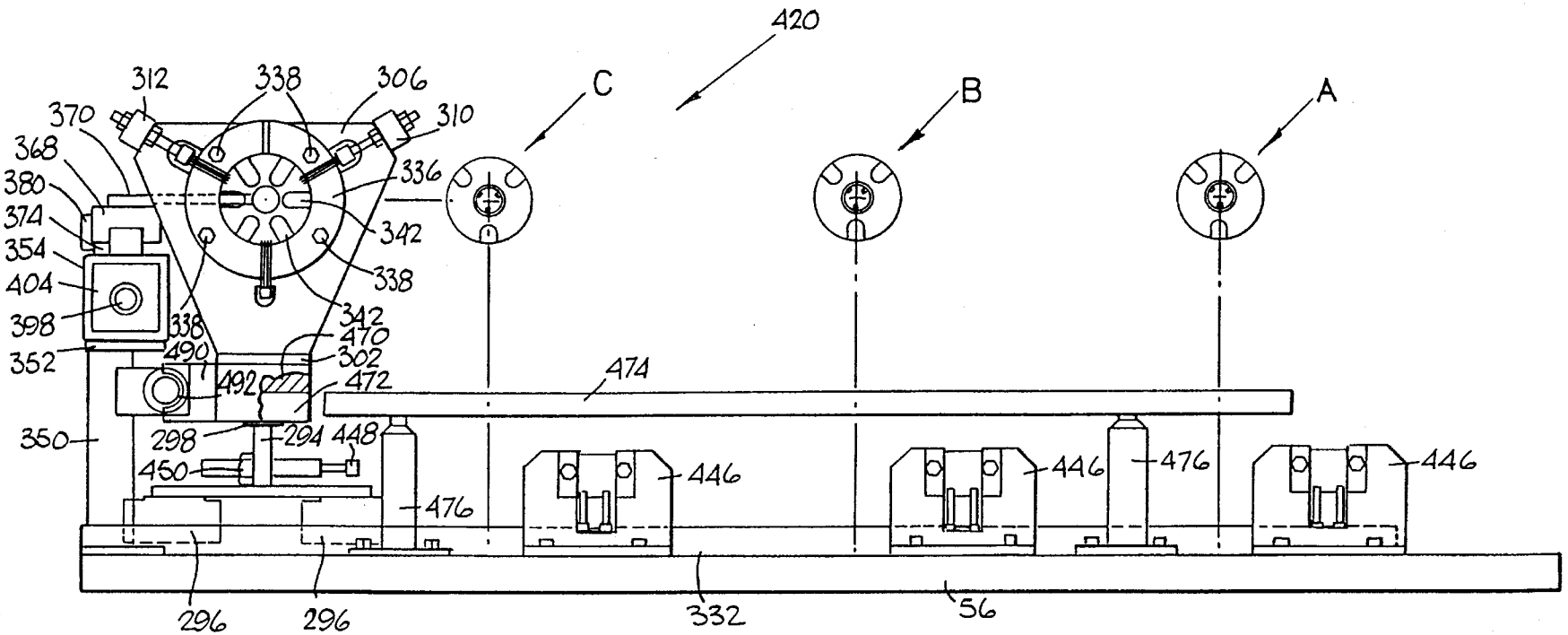
FIG. 9 is a side elevational view with parts removed of the transfer portion of this invention.
Figures 10, 11:
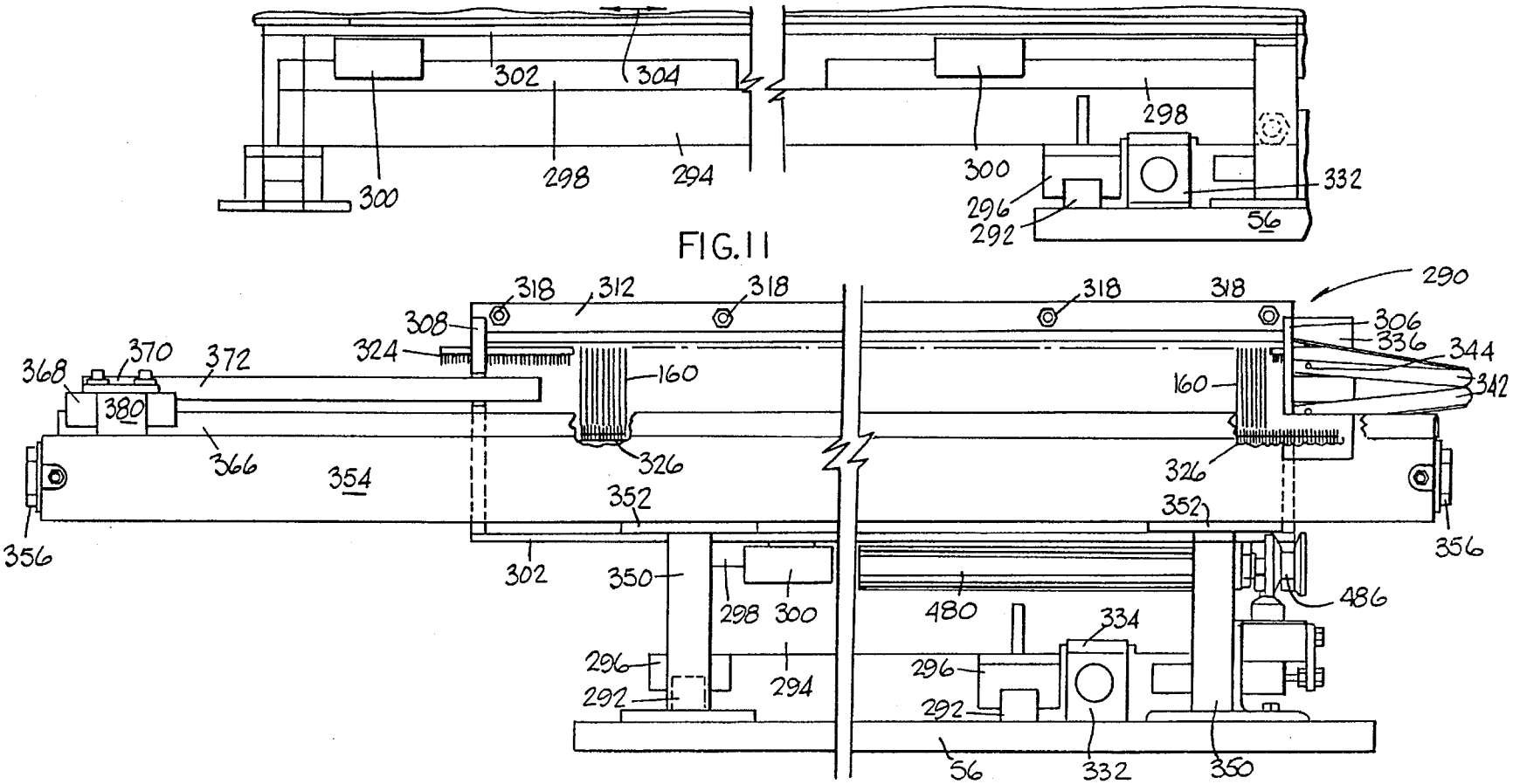
FIG. 10 is an end elevational view from the left side of FIG. 9.
FIG. 11 is a view similar to FIG. 10 but illustrating different parts and having parts removed.

The container end accumulating and transfer means are illustrated in FIGS. 9–20. The container end transfer means 290 is illustrated in FIGS. 9–15 and comprises a pair of spaced apart guide rails 292, similar to the guide rails 86, mounted on the bed plate 56. A support beam 294 extends between and is secured to bearing slides 296, similar to the bearing slides 88, for sliding movement over the guide rails 292. There are two bearing slides 296 on one end of the support beam 294 and one bearing slide on the other end of the support beam 294. Two aligned guide rails 298, FIG. 11, are mounted on the support beam 294 and two bearing slides 300 are mounted on a support plate 302 so that the support plate 302 may be moved in the directions indicated by the arrow 304. A support bracket 306 is mounted on one end of the support plate 302 and another support bracket 308 is mounted on the other end of the support plate 302. A pair of spaced apart support bars 310 and 312 extend between and are secured to upper corner portions 314 and 316, FIG. 14, of the support brackets 306 and 308 by suitable means, such as by welding (not shown). A plurality of adjustable mounting means 318 are mounted on each of the support bars 310 and 312 and carry holders 320, FIG. 14, in which are secured the metal ends 322 of the brushes 324. The metal end 326 of the brush 328 is mounted in a fixed holder 330. As illustrated in FIG. 10, the brushes 324 and 328 support the container ends 160. As illustrated in FIG. 15, the brushes 324 and 328 extend outwardly past the bracket 308 for purposes described below. A rodless cylinder 332 is mounted on the bed plate 56 and has a bracket 334, FIG. 10, connecting it to the support beam 294 to move the bearing slides 296 over the guide rails 292. A split support block 336, FIG. 9, is secured to the bracket 306 by headed threaded bolts 338. A plurality of circumferentially spaced apart inclined slots 340, FIG. 13, are formed in the split support block 336 and a resilient finger 342 is secured in each slot by a screw 344.

Moving means for pushing the container ends 160 over the brushes 324 and 326 and through the resilient fingers 342 are illustrated in FIGS. 9–11 and 16–18. A pair of spaced apart support posts 350 are fixedly mounted on the bed plate 56 and have support plates 352 secured thereto and on which is mounted a relatively rigid hollow support tube 354 which preferably has a rectangular transverse cross-sectional configuration and a longitudinal axis and is formed from steel plate and has a wall thickness of about 0.25 inch. Mounting means 356 are provided at each end of the relatively rigid hollow support tube 354 for mounting a rodless cylinder 358, FIGS. 16–18, similar to the rodless cylinder 260, in the relatively rigid hollow support tube 354. The rodless cylinder 358 comprises a hollow cylindrical shaft 360 and a piston 362 slidably mounted in the hollow cylindrical shaft 360. An external yoke 364 is slidably mounted on the hollow cylindrical shaft 360 and is magnetically coupled to the piston 362 for movement therewith. A guide rail 366, similar to the guide rail 86, is mounted on the relatively rigid hollow support tube 354 and a bearing slide 368, similar to the bearing slide 88, is mounted on the guide rail 366 for sliding movement thereover. A support plate 370 is mounted on the bearing slide 368 and has an elongated rod 372 secured thereto for movement therewith. The elongated rod 372 is located to contact the center portion of the last container end 160, as described below, to apply a force thereto. A longitudinally extending slot 374 is formed in the relatively rigid hollow support tube 354. A bracket 376 is mounted on the external yoke 364 using headed threaded bolts 378 and projects upwardly through the longitudinally extending slot 374 above the elongated rectangular tube 354. A plate member 380 is secured to the bearing slide 368 by headed threaded bolts 382. Coupling means are provided so that movement of the bracket 376 moves the plate member 380. In a preferred embodiment of the invention, the plate member 380 has a plurality of cut-out portions 384 so that welds 386 may be formed to secure the plate member 380 and the bracket 376 together, as described below. This structure permits the bearing slide 368, the guide rail 366 and the elongated rectangular tube 354 to absorb the force being applied by the elongated rod 372 on the container ends 160. It may be possible that the coupling means could comprise a pair of spaced apart fingers on the plate member 380 and a projecting boss on the bracket 376 located between the spaced apart fingers so that movement of the bracket 376 moves the plate member 380.

Figure 16:
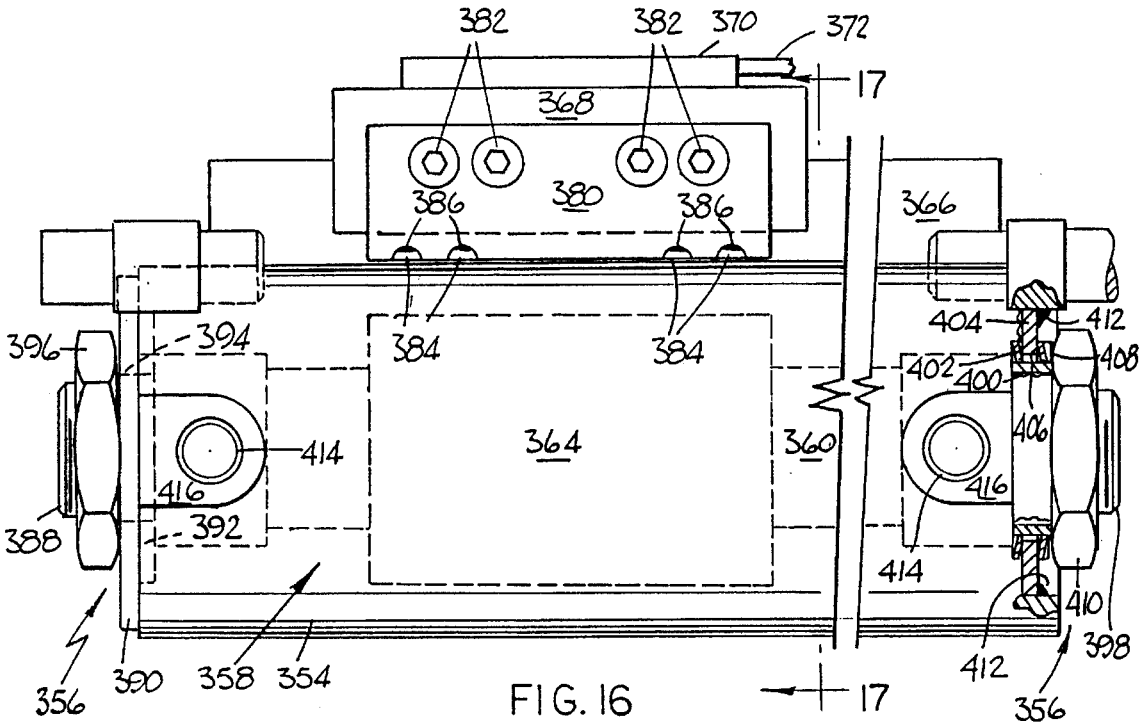
FIG. 16 is an enlarged elevational view of a portion of FIG. 11.
Figure 17:
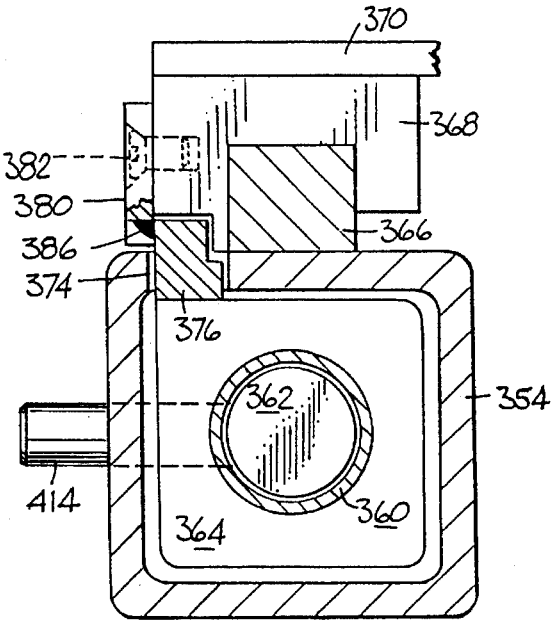
FIG. 17 is a cross-sectional view taken on the line 17—17 of FIG. 16.
Figure 18:
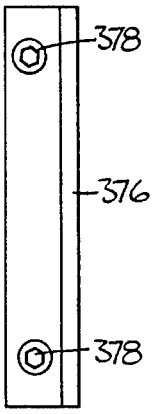
FIG. 18 is top plan view of a portion of FIG. 17.

In FIGS. 16–18, there is illustrated one preferred embodiment of support means for mounting the rodless cylinder 358 in the relatively rigid hollow support tube 354. An externally threaded first extension member 388 extends outwardly from one end portion of the hollow cylindrical shaft 360. An end cover 390 has an integral reduced portion 392 that is dimensioned to fit snugly within the end portion of the relatively rigid hollow support tube 354. The end cover 390 has a central circular opening 394 so that the first extension member 388 may pass through the central opening 394 and a lock nut 396 is used to secure the end cover 390 on the one end portion of the cylinder 362. An externally threaded second extension member 398 extends outwardly from the other end portion of the cylinder 362. An annular spacer 400 is positioned over the second extension member 398. A first annular spring washer 402 is positioned over the annular spacer 400. A support member 404 having a transverse cross-sectional configuration corresponding to the transverse cross-sectional configuration of the relatively rigid hollow support tube 354 has a central circular opening 406 having a diameter greater than the diameter of the outer surface of the annular spacer 400 and is positioned so that at least a portion of the annular spacer 400 is located therein. Therefore, limited movement of the annular spacer 400 in the central opening 406 is permitted. A second annular spring washer 408 is positioned over the annular spacer 400. An internally threaded lock nut 410 is threaded onto the second extension member 398 and tightened until the annular spacer 400 is in contact with the other end portion of the cylinder 362 and the lock nut 410. The first and second annular spring washers 402 and 408 exert a resilient force on the support member 404 so that if an external force is applied to the other end portion of the cylinder 362, the annular spacer 400 is moved to a new location and when the external force is removed, the first and second annular spring washers 402 and 408 will hold the annular spacer 400 at the new location. This permits centering of the hollow cylindrical shaft 360 in the relatively rigid hollow support tube 354. The above-described structures are assembled outside of the relatively rigid support tube 354. After assembly, the support member 404 is inserted into one end of the relatively rigid hollow support tube 354 and moved therethrough until the end cover 390 is in contact with the one end of the relatively rigid hollow support tube 354. The support member 404 is then secured to the relatively rigid hollow support tube 354 by welding 412. The external yoke 364, the piston 362 and the bearing slide 368 are moved to the left side of FIG. 16 and the bracket 376 is secured to the plate member 380 by welding. This ensures the proper alignment of the bearing slide 368 and the external yoke 364. Fittings 414 are then mounted on each end portion of the hollow cylindrical shaft 360 so that they can be connected to a source of pressurized air (not shown) so as to move the piston 362. The fittings 414 pass through openings 416 formed in the relatively rigid hollow support tube 354. The rodless bearing 260 is mounted in the same manner.

Figure 12:
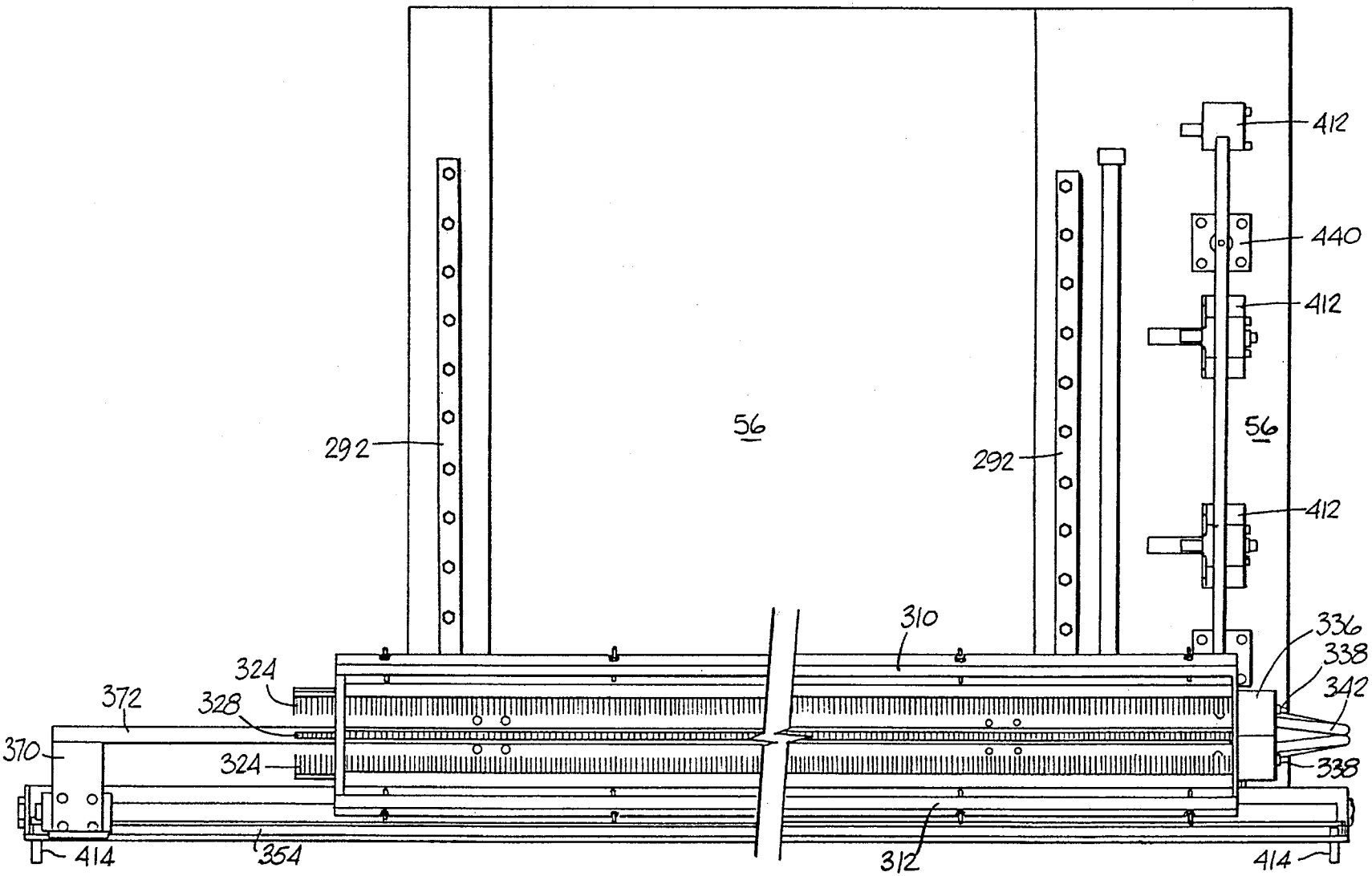
FIG. 12 is a top plan view of FIG. 10.
Figure 19:
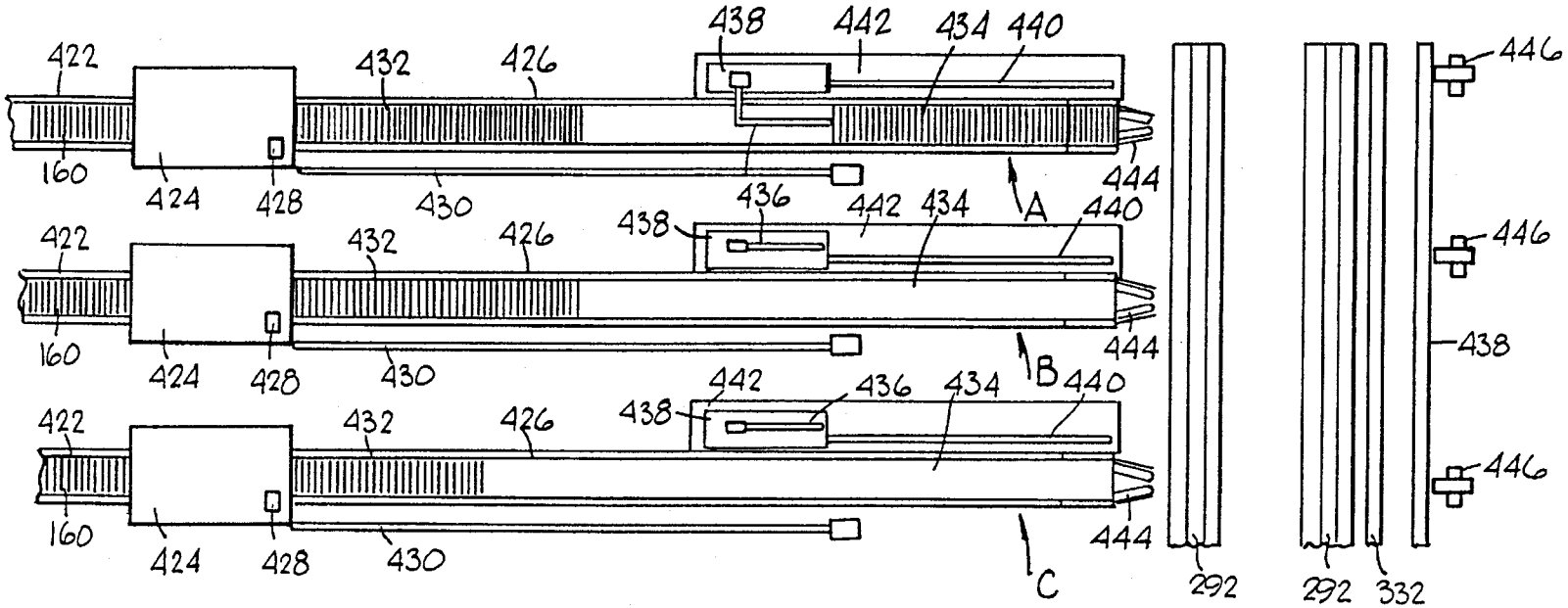
FIG. 19 is a schematic illustration of the accumulating portion and part of the transfer portion of this invention.
Figure 20:
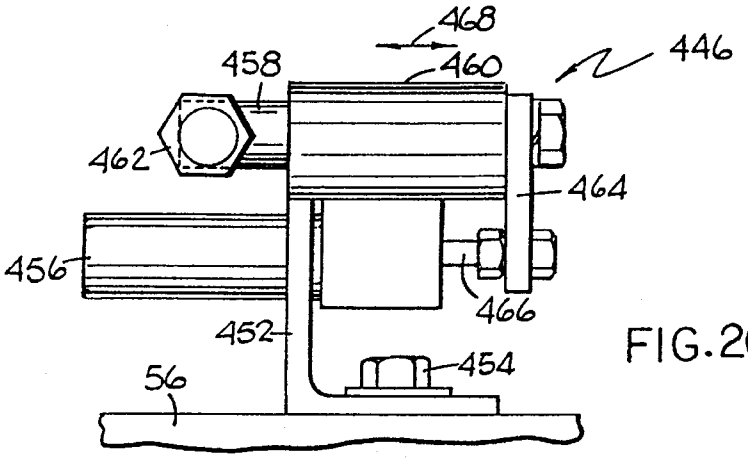
FIG. 20 is an enlarged elevational view of a portion of FIG. 19.
Figure 24:
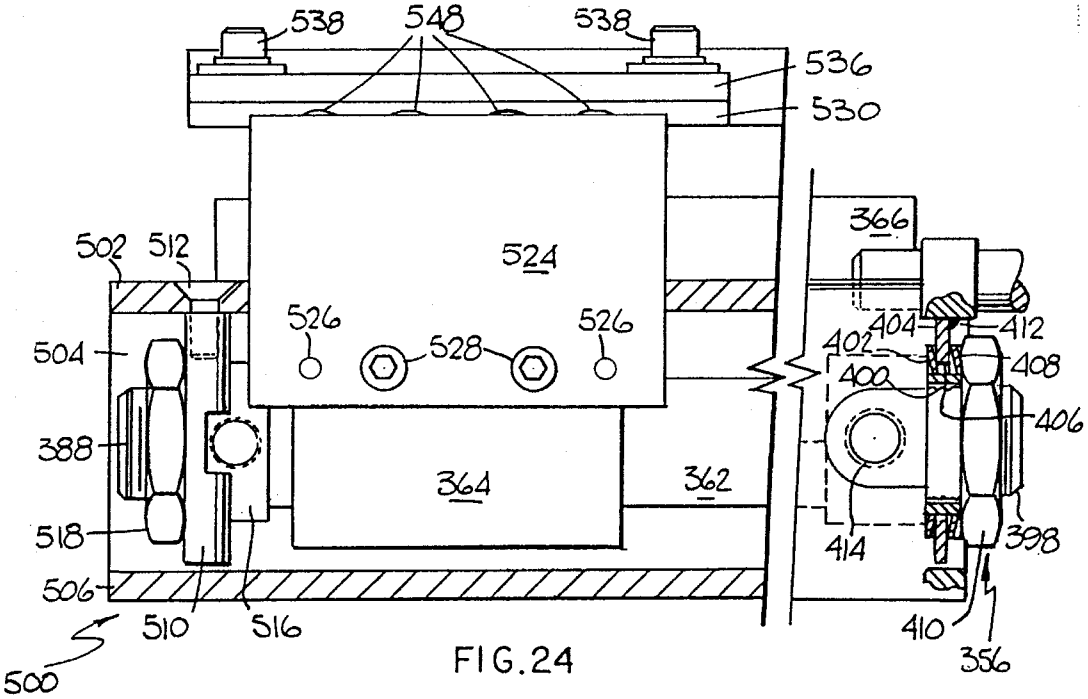
FIG. 24 is a view similar to FIG. 16 of another preferred support means for mounting the rodless cylinder.
Figure 26:
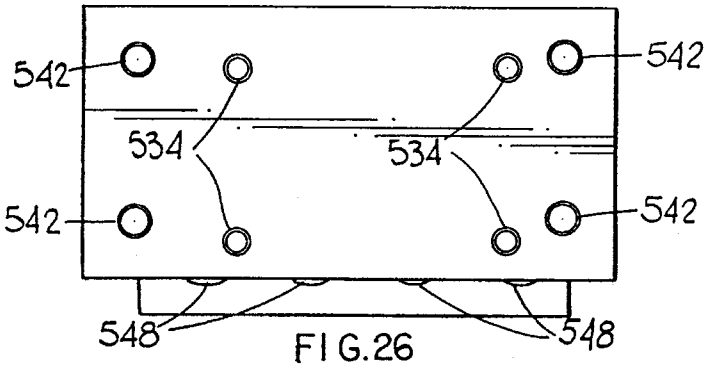
FIG. 26 is a top plan view with parts removed of a portion of FIG. 24.

In FIG. 19, there is illustrated conventional accumulating means 420 for providing three accumulating stations A, B and C for accumulating container ends 160. Container ends 160 are fed from a container end making apparatus (not shown) over guide tracks 422 to conventional counters 424 and then to accumulating racks 426. The accumulating racks 426 are provided with conventional means to prevent the container ends from falling over. After a predetermined number of container ends 160 have been counted, a moving mechanism 428 moves over the rail 430 to move the predetermined number of container ends 160 from a first location 432 to a second location 434. An elongated rod 436 is pivotally mounted on a bearing slide 438, similar to the bearing slide 368 and its associated moving rodless cylinder 358, so that it can be moved between a location at which it can contact the container ends 160 at the second location 434 (accumulating station A) and a location at which the container ends 160 can be moved from the first location 432 to the second location 434 (accumulating stations B and C). The bearing slide 438 moves over a guide rail 440 mounted on a relatively rigid hollow support tube 442 similar to the relatively rigid hollow support tube 354. Each accumulating rack 426 has a plurality of resilient fingers 444, similar to the resilient fingers 342, mounted at one thereof. When the brushes 324 and 328 are moved over the guide rails 292, the ends of the brushes 324 and 328 move over the resilient fingers 444 so that the ends of the resilient fingers 444 are within the brushes 324 and 328 so that they will move into contact therewith as the container ends 160 are pushed by the elongated rod 436 through the resilient fingers 444 and over the brushes 324 and 326 from the second location 434 to the location illustrated in FIG. 12. Stop means 446 are mounted on the bed plate 56. A shock absorbing piston 448, FIG. 9, is adjustably mounted by means 450 on the support beam 294 and is located to contact the stop means 446 so as to stop the movement of the brushes 324 and 328 so that they are aligned with accumulating station A, B or C. As illustrated in FIG. 20, each stop means 446 comprise an adjustable bracket 452 mounted on the bed plate 56 by headed threaded bolts 454. An air cylinder 456 is mounted on the bracket 452. A rod 458 is slidably mounted in a external yoke 460 secured to the bracket 452 and has a stop member 462 thereon. A plate 464 is coupled to the rod 458 and the piston rod 466 so that movement of the piston rod 466 moves the rod 458 in the directions indicated by the arrow 468 to move the stop member 462 between a location at which it will be contacted by the shock absorbing piston 448 or a location at which the shock absorbing piston 448 will pass by the stop member 462. The stop member for positioning the transfer means at accumulating station A does not have to be of the type illustrated in FIG. 20 and can be only a stop block 412, as illustrated in FIG. 12. A block member 470, FIG. 9, is secured to the support plate 302 by suitable means, such as by welding (not shown), and has a recessed portion 472. A support rail 474 is mounted on support posts 476 adjustably mounted on the bed plate 56. As the brushes 324 and 328 are moved over the guide rails 292, the recessed portion 472 moves over the support rail 474 and provides resistance to the forces generated by the movement of the container ends 160 as they are pushed over the brushes 324 and 328.

Apparatus is provided for moving the brushes 324 and 328 and the resilient fingers 342 from the location illustrated in FIG. 10 to the position illustrated in FIG. 13. An air cylinder 480 is mounted on the support post 350 and has a movable piston rod 482 which moves in the directions indicated by the arrow 484. A member 486 having spaced apart flange portions 488 is mounted on the piston rod 482. A plate member 490, FIG. 9, extends outwardly from a portion of the block 470 at a location so that movement of the block 470 over the support rail 474 is permitted and is either integral with or secured to the block 470 by suitable means, such as by bolts (not shown). The plate member 490 has a semi-circular cut-out portion 492 so that it can be moved between the flange portions 488. Therefore, movement of the piston rod 482 in one direction will move the brushes 324 and 328 and the resilient fingers 342 over the guide rails 298 from the position illustrated in FIG. 11 to that illustrated in FIG. 13 and movement of the piston rod 482 in the opposite direction will move them back to the position in FIG. 11.

In operation, the rodless cylinder 332 is actuated to move the brushes 324 and 328 over the guide rails 292 in FIG. 19 until the longitudinal axis of the space between the brushes 324 and 328 is in alignment with the longitudinal axis of the accumulating rack 426 at accumulating station A. As illustrated in FIG. 15, the end portions of the brushes 324 and 328 are spaced apart so that they may be moved over the resilient fingers 444 and have the end portions of the resilient fingers 444 located therebetween. The resilient fingers 444 function to prevent the container ends 160 from falling over as they are pushed by the elongated rod 436 out of the second location 434, through the resilient fingers 444 and over the brushes 324 and 326 to the location between the brushes 324 and 326 as illustrated in FIG. 10. The rodless cylinder 332 is then actuated to move the brushes 324 and 328 with the container ends 160 confined therebetween back over the guide rails 292 to the location illustrated in FIGS. 10 and 11. When the brushes 324 and 328 are in the position illustrated in FIGS. 10 and 12, the longitudinal axis of the space between the brushes 324 and 328 lies in a plane extending through the centerlines of the crushing heads 124 and 136.

Figure 21:
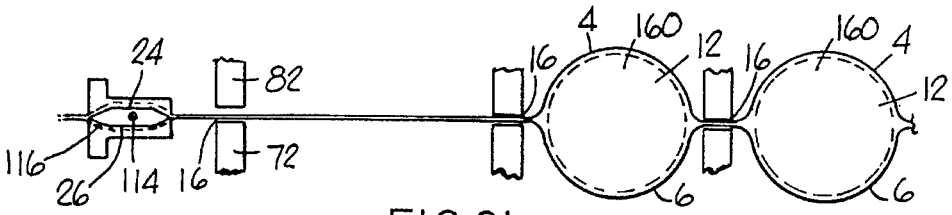
FIGS. 21–23 are schematic illustrations of the operation of one portion of the apparatus of this invention.
Figure 22:
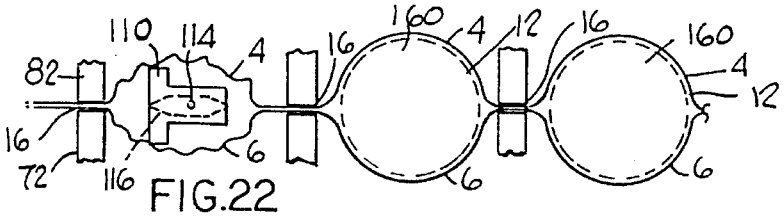

FIG. 3 and the schematic illustration in FIG. 21 illustrate the location of various portions of the apparatus at the beginning of the loading of container ends 160 into the open ended compartments 12. The upper and lower holding means 208 and 188 are in a closed position with a seam 116 clamped between the clamping means 210. The upper clamping member 82 is in a raised position. The crushing heads 124 and 136 are in the open position. The air nozzle 114 is in the retracted position. To begin the loading, the air cylinder 106 is actuated so that the piston rod 108 moves the air nozzle 114 to the right in FIG. 3 until the axis of the air nozzle 114 is in the plane between the centerlines of the crushing heads 124 and 136. At the same time or immediately thereafter, the upper clamping member 82 is lowered so that a seam 16 is clamped between the upper clamping member 82 and the lower clamping member 72. The air cylinder 90 is actuated to move the upper and lower clamping members 82 and 72 toward the crushing heads 124 and 136 so that adjacent seams 16 are moved closer to each other. As described above, the air nozzle 114 is located between the sheets 4 and 6 at the open end 22. Air is passed through the air nozzle 114 into an open ended compartment 12 to at least partially separate the strips 4 and 6 forming the open ended compartment 12. This position is illustrated schematically in FIG. 22. The air cylinder 106 is then actuated so that the piston rod 108 returns the air nozzle 114 back to its original position.

At this time, the brushes 324 and 328 and the resilient fingers 342 are located as illustrated in FIG. 10 and the resilient fingers 342 are immediately in front of the at least partially opened compartment 12. The air cylinder 480 is then actuated so that the piston rod 482 applies a force on the plate member 490 to move the brushes 324 and 328 and the resilient fingers 342 to the right in FIG. 11 so that the resilient fingers 342 move into the at least partially opened compartment 12, FIG. 13. The rodless cylinder 358 is then actuated to move the elongated rod 372 into contact with the container ends 160 between the brushes 324 and 328. The continued movement of the elongated rod 372 pushes the container ends 160 through the resilient fingers 342 and into the at least partially opened compartment 12. The resilient fingers 342 function to hold the container ends 160 in the upright position as they are pushed into the at least partially opened compartment 12 and after that the strips 4 and 6 forming the open ended compartment 12 perform that function. Although the counters 424 are consistently accurate in counting the predetermined number of container ends 160, the actual length of the predetermined number of container ends 160, such as 500 container ends, may vary as much as 4.0 inches. To accommodate for this, the elongated rod 372 is located so that at the end of its stroke, the portion thereof in contact with the container ends 160 is located approximately 4.0 inches from the edge portions 10 of the strips 4 and 6, as illustrated in FIG. 13. At the other end of the compartment 12, the actual length of the container ends 160 in the compartment 12 is accommodated by the bars 28 of adhesive. As the container ends 160 are pushed into the compartment 12, they will only break apart as many bars 28 of adhesive as necessary to keep the container ends 160 in an upright position. The rodless cylinder 358 and the air cylinder 480 are then actuated to move the elongated rod 372, the brushes 324 and 328 and the resilient fingers 342 back to their original locations as illustrated in FIG. 10. The strips 4 and 6 forming the compartment 12 will hold the container ends 160 in the upright position until the open ended compartment 12 is partially closed.

The air cylinders 120 and 132 are then actuated to move the crushing heads 124 and 136 together so that the portions of the strips 4 and 6 between the edge portions 10 and the first container end 160 are crushed together between the convex surface 140 and the concave surface 142. The air cylinders 120 and 130 are actuated to return the crushing heads 124 and 136 to their original location. The air cylinders 80 and 90 are actuated to move the upper clamping bar 82 back to its original locations.

At the same time as the container ends 160 are being pushed into the compartment 12, a partially closed compartment 12 having container ends 160 confined therein is being severed and conveyed to a palletizing area as described above.

Figure 23:
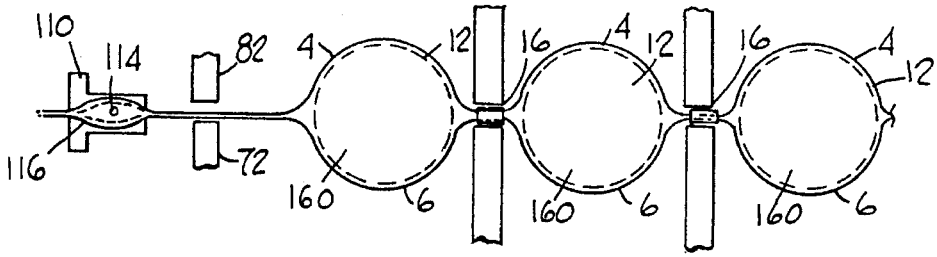

As illustrated schematically in FIG. 23, the compartments 12 having containers 160 confined therein are ready to be moved to the right in FIGS. 3 and 23. The air cylinder 168 is actuated so that the piston rod 174 moves the support plate 166 and therefore the upper and lower holding means 208 and 188 to the right. This movement moves the partially closed compartments 12 having container ends 160 confined therein and supported on the support bars 226 over the support bars 226 toward the cutting apparatus 232. At the same time, the most recently filled compartment 12 is pulled over the front edges 230 of the support bars 226. When the piston rod 174 has been fully extended, the air cylinders 180 are actuated to move the lower holding means 188 downwardly so that the partially closed compartment 12 having container ends 160 confined therein is now supported on the support bars 226. At the same time, the air cylinders 200 are actuated to move the upper holding means 208 upwardly. When the piston rods 182 and 202 have been fully retracted, the air cylinder 168 is actuated to move the piston rod 174 to the left in FIG. 3. It is noted that the stroke of the piston rods 202 is twice the stroke of the piston rods 182. When the piston rod 174 has been fully retracted, the air cylinders 180 are actuated to move the lower holding means 188 upwardly and the air cylinders 200 are actuated to move the upper holding means 208 downwardly so that the most recently filled partially closed compartment 12 is located between the arcuate recesses 190 and 210. The apparatus is once again in position to repeat the above-described operations.

Figure 25:
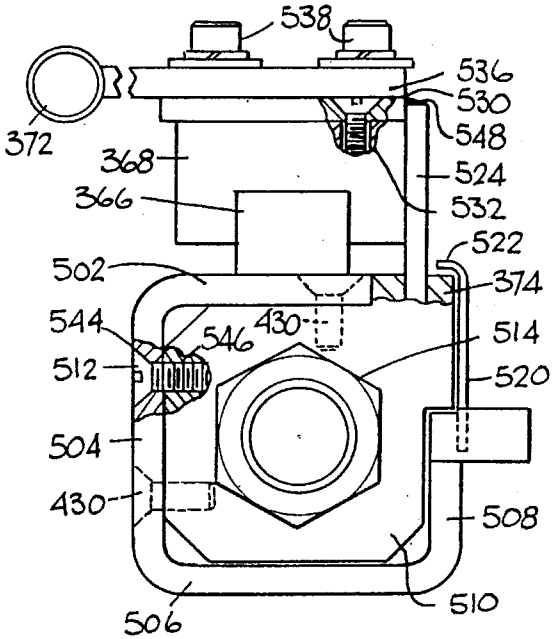
FIG. 25 is an end elevational view taken from the left side of FIG. 24.
Figure 27:
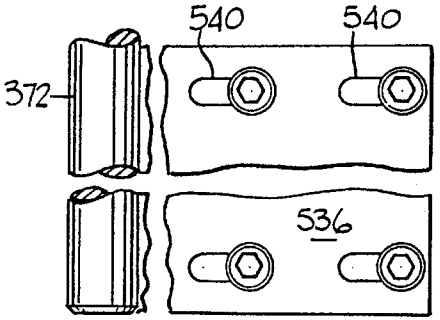
FIG. 27 is a top plan view with parts removed of a portion of FIG. 25.

In FIGS. 24–27, there is illustrated another preferred embodiment of support means for mounting the rodless cylinder 358 in a relatively rigid generally tubular support is in the form of a relatively rigid open sided support tube 500 having a partial top wall 502, a full sidewall 504, a full bottom wall 506 and a partial sidewall 508. The open sided tube 500 is formed by bending a sheet of metal, such as steel plate having a thickness of about 0.25 inch. The structures in FIGS. 24–27 corresponding to those in FIGS. 16–18 will be given the same reference numerals. An end support bracket 510 is securely mounted on the partial top wall 502 and the full sidewall 504 using headed threaded bolts 512. As illustrated in FIG. 25, the support bracket 510 is in contact with the partial top wall 502 and the full sidewall 504 but is spaced from the full bottom wall 506 and the partial sidewall 508. The end support bracket 510 has a hexagonally shaped opening 514 formed therein and an externally threaded first extension member 388 passes therethrough. A flange portion 516 abuts against one side of the opening 514 and a threaded nut 518 is tightened to secure the externally threaded first extension member 388 on the end support bracket 510. A cover plate 520 is secured to the partial sidewall 508 and has a flange portion 522 to cooperate with the partial top wall 502 to form the slot 374. A guide rail 366 is mounted on the partial top wall 502 and a bearing slide 368 is mounted on the guide rail 366 for sliding movement thereover. A bracket 524 is secured to the external yoke 364 using dowel pins 526 and threaded bolts 528. A support plate 530 is secured to the bearing slide 368 using headed threaded bolts 532 passing through openings 534 in the support plate 530. A plate member 536 is mounted on the support plate 530 using headed threaded bolts 538 passing through slots 540 and threaded into threaded openings 542 in the support plate 530. The elongated rod 372 is secured on the plate member 536. As described above relative to FIGS. 16–18, the above-described structures are assembled outside of the relatively rigid open sided support tube 500. After assembly, the support member 404 is inserted into one end of the relatively rigid open sided support tube 500 and moved therethrough until openings 544 in the partial top wall 502 and full sidewall 504 are aligned with threaded openings 546 in the end support bracket 528. The headed threaded bolts 512 are then used to secure the end support bracket 510 on the partial top wall 502 and the full sidewall 504. The support member 404 is then secured to the partial top wall 502 and the full sidewall 504 by welding 412 so that the support member 404 is spaced from the full bottom wall 506 and the partial sidewall 508. The external yoke 360, the piston 364 and the bearing slide 368 are moved to the left side of FIG. 24 and the bracket 524 is secured to the support plate 530 by welding 548. This ensures the proper alignment between the bearing slide 368 and the external yoke 360.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for packaging a plurality of articles comprising:

base support means located at a relatively fixed location;

moving means for moving a continuous strip of material having a plurality of interconnected compartments each having one open end through a plurality of work stations in a predetermined linear direction;

said interconnected open ended compartments comprising at least two superposed sheets of a flexible material having opposite edge portions defining the width thereof and lengthwise and widthwise extending joining means for joining superposed portions of said at least two superposed sheets to form said open ended compartments;

said open ended compartments having parallel horizontally extending longitudinal axes extending in said widthwise direction and perpendicular to said predetermined linear direction;

said open ended compartments moving in the lengthwise direction with the open ends of said open ended compartments being located along one of said opposite edge portions;

opening means for moving the portions of said at least two superposed sheets of at least one of said open ended compartments in opposite directions to form a generally circular opening therein;

transfer means for holding a plurality of articles;

force applying means for applying a force on said plurality of articles to move said plurality of articles out of said transfer means, through said generally circular opening and into said at least one of said open ended compartments;

closing means for at least partially closing the portions of said at least two superposed sheets adjacent to said generally circular opening to form at least a partially closed compartment having said plurality of articles contained therein;

holding means for holding said at least a partially closed compartment;

said moving means moving said holding means to move said at least a partially closed compartment toward a third work station to form a plurality of interconnected partially closed compartments;

severing means for severing said widthwise joining means to form one separated partially closed compartment; and said movement of said at least a partially closed compartment also moving said continuous strip of material.

2. The invention as in claim 1 and further comprising:

slidable support means for supporting at least a portion of said opening means on said frame; and first reciprocating means for reciprocating said slidable support means in first linear directions.

3. The invention as in claim 2 wherein said at least a portion of said opening means comprises:

clamping means mounted on said slidable support means for movement therewith for applying a clamping force on at least a portion of at least one of said widthwise joining means and moving it toward the next preceding one of said widthwise joining means;

blowing means mounted on said slidable support means for movement therewith for blowing a stream of air into said one of said open ended compartments located in said first section to form said generally circular opening; and second reciprocating means for reciprocating said blowing means in linear directions parallel to said first linear directions relative to said slidable support means to move said blowing means between a location in alignment with said generally circular opening and a location spaced in a radial direction from said generally circular opening.

4. The invention as in claim 3 wherein said clamping means comprises:

a fixed portion;

a movable portion moving into or out of the clamping relationship; and second moving means for moving said movable portion into or out of said clamping relationship.

5. The invention as in claim 2 wherein said closing means comprise:

a first crushing head mounted on said frame for reciprocation in linear directions perpendicular to said first linear directions;

third reciprocating means for reciprocating said first crushing head;

a second crushing head mounted on said frame for reciprocating movement in linear directions perpendicular to said first linear directions and located to cooperate with said first crushing head to apply said force; and fourth reciprocating means for reciprocating said second crushing head.

6. The invention as in claim 5 wherein:

said lengthwise extending joining means is adjacent to one of said opposite edge portions; and said widthwise extending joining means has one end thereof in contact with at least a portion of said lengthwise joining means and the other end thereof spaced from the other of said opposite end portions.

7. The invention as in claim 3 wherein:

said blowing means comprises an air nozzle having an exit end through which the air passes; and said exit portion being located between said at least two superposed sheets adjacent to said other of said opposite edge portions.

8. The invention as in claim 1 and further comprising:

a plurality of accumulating means each of which accumulates a predetermined number of said articles;

said plurality of accumulating means having parallel longitudinal axes;

each of said plurality of accumulating means having discharging means for discharging said accumulated articles from each of said plurality of accumulating means;

said transfer means receiving and holding said discharged articles from each of said accumulating means and having a longitudinal axis;

second moving means for moving said transfer means in linear directions so that said longitudinal axis thereof is aligned with said longitudinal axis of one of said accumulating means when said accumulated articles are being received from said one of said accumulating means and for moving said transfer means so that said longitudinal axis of said transfer means is aligned with said generally circular opening.

9. The invention as in claim 8 wherein said force applying means comprise:

a rodless cylinder;

an external yoke mounted for reciprocating sliding movement over said rodless cylinder; and a work performing tool mounted on said external yoke and located to contact at least the end one of said articles.

10. The invention as in claim 9 and further comprising:

mounting means for mounting said rodless cylinder on said base support means.

11. The invention as in claim 10 wherein said mounting means comprise:

a relatively rigid hollow support having opposite end portions and a longitudinal axis;

said rodless cylinder having opposite end portions;

support means at each of said opposite end portions for supporting said rodless cylinder;

an external guide rail mounted on said relatively rigid generally tubular support;

slidable bearing means mounted on said external guide rail for sliding movement thereover;

coupling means for coupling said slidable bearing means and said external yoke so that movement of said external yoke moves said slidable bearing means; and said work performing tool mounted on said slidable bearing means for movement therewith so that forces applied to said work performing tool will be absorbed by said slidable bearing means, said guide rail and said relatively rigid generally tubular support.

12. The invention as in claim 11 and further comprising:

said relatively rigid hollow support having a longitudinally extending slot formed therein; and at least a portion of said coupling means extending through said longitudinally extending slot.

13. The invention as in claim 12 wherein said coupling means comprise:

a bracket mounted on said external yoke and located so that at least a portion thereof extends through said longitudinally extending slot;

a plate member mounted on said slidable bearing means; and connecting means for connecting said bracket and said plate member together so that said plate member moves with said bracket.

14. The invention as in claim 13 wherein said connecting means comprise:

at least one weld.

15. The invention as in claim 12 and further comprising:

a first extension member on one of said opposite end portions of said rodless cylinder;

an end cover having a circular hole extending therethrough;

said first extension member passing through said circular hole and having at least a portion thereof projecting outwardly from said end cover;

first securing means for securing said end cover on one of said opposite end portions of said rodless cylinder;

a support member having a transverse cross-sectional configuration slightly smaller than the transverse cross-sectional configuration of said relatively rigid hollow support so that said support member may be moved into said relatively rigid hollow support;

said support member having a circular hole extending therethrough;

a second extension member on the other of said opposite end portions of said rodless cylinder;

said second extension member passing through said circular hole and having at least a portion thereof projecting outwardly from said support member;

second securing means for securing said support member to said relatively rigid hollow support with at least portions of said end cover in contact with one of said opposite end portions of said relatively rigid hollow support; and mounting means for mounting said other end portion of said rodless cylinder on said support member to permit movement of said other end portion of said rodless cylinder generally in radial directions relative to said support member.

16. The invention as in claim 15 wherein said mounting means for mounting said other end portion of said rodless cylinder on said support member comprises:

an annular spacer member mounted on said second extension member;

said annular spacer member having an outer diameter less than the inner diameter of said circular hole in said support member; and third securing means for securing said annular spacer member on said other of said opposite end portions of said rodless cylinder.

17. The invention as in claim 16 and further comprising:

resilient means mounted on said annular spacer member for applying a resilient force between said support member and said other of said opposite end portions of said rodless cylinder and between said support member and said third securing means to hold said annular spacer member at a relatively fixed position in said circular hole of said support member until moved by the application of an external force thereto.

18. The invention as in claim 17 wherein said coupling means comprise:

a bracket mounted on said external yoke and located so that at least a portion thereof extends through said longitudinally extending slot;

a plate member mounted on said slidable bearing means; and fourth securing means for securing said bracket and said plate member together.

19. The invention as in claim 18 wherein said fourth securing means comprise:

at least one weld.

20. The invention as in claim 19 wherein:

said relatively rigid hollow support has a rectangular transverse cross-sectional configuration and is formed from metal.

21. The invention as in claim 11 wherein said relatively rigid hollow support comprises:

an elongated partial top wall;

a full sidewall integral with said partial top wall;

a full bottom wall integral with said full sidewall;

a partial sidewall; and a cover plate secured to said partial sidewall and having a flange portion extending toward but spaced from said partial top wall to form a longitudinally extending slot therebetween.

22. The invention as in claim 21 and further comprising:

a first extension member on one of said opposite end portions of said rodless cylinder;

an end support having an opening extending therethrough;

said first extension member passing through said opening and having at least a portion thereof projecting outwardly from said end support;

first securing means for securing said end support on one of said opposite end portions of said rodless cylinder;

second securing means for securing said end support on said relatively rigid hollow support;

a support member having a transverse cross-sectional configuration slightly smaller than the transverse cross-sectional configuration of said relatively rigid hollow support so that said support member may be moved into said relatively rigid hollow support;

said support member having a circular hole extending therethrough;

a second extension member on the other of said opposite end portions of said rodless cylinder;

said second extension member passing through said circular hole and having at least a portion thereof projecting outwardly from said support member;

third securing means for securing said support member to said relatively rigid hollow support with at least portions of said end support secured to at least portions of said relatively rigid hollow support; and mounting means for mounting said other end portion of said rodless cylinder on said support member to permit movement of said other end portion of said rodless cylinder generally in radial directions relative to said support member.

23. The invention as in claim 22 wherein said mounting means for mounting said other end portion of said rodless cylinder on said support member comprises:

an annular spacer member mounted on said second extension member;

said annular spacer member having an outer diameter less than the inner diameter of said circular hole in said support member; and fourth securing means for securing said annular spacer member on said other of said opposite end portions of said rodless cylinder.

24. The invention as in claim 23 and further comprising:

resilient means mounted on said annular spacer member for applying a resilient force between said support member and said other of said opposite end portions of said rodless cylinder and between said support member and said third securing means to hold said annular spacer member at a relatively fixed position in said circular hole of said support member until moved by the application of an external force thereto.

25. The invention as in claim 24 wherein said coupling means comprise:

a bracket mounted on said external yoke and located so that at least a portion thereof extends through said longitudinally extending slot;

a plate member mounted on said slidable bearing means; and fifth securing means for securing said bracket and said plate member together.

26. The invention as in claim 8 and further comprising:

guide means for guiding the movement of said articles from said transfer means into said at least one of said open ended compartments.

27. The invention as in claim 26 and further comprising:

said guide means being mounted on said transfer means for movement therewith; and reciprocating means for reciprocating said transfer means between locations whereat said guide means are spaced from said generally circular opening and whereat at least a portion of said guide means has passed through said generally circular opening and are within a portion of said at least one of said open ended compartments.

28. The invention as in claim 27 wherein said guide means comprise:

a plurality of flexible resilient fingers, each having one end thereof secured to said transfer means and the other end thereof free to be moved;

said other ends being normally in a relatively close relationship to ensure the passing thereof through said generally circular opening; and said plurality of flexible resilient fingers applying a force on said articles as they pass through said guide means to ensure that said articles remain in a desired relationship as they are moved from said transfer means into said at least one of said open ended compartments.

29. The invention as in claim 8 wherein said second moving means comprise:

at least a pair of spaced apart guide rails mounted on said frame;

at least one bearing slide mounted for sliding movement over each of said at least a pair of spaced apart guide rails;

support means mounted on said bearing slides for supporting said transfer means; and drive means for moving said second moving means.

30. The invention as in claim 29 and further comprising:

a plurality of stop means for stopping the movement of said transfer means at desired locations for transferring said articles from said accumulating means to said transfer means.

31. The invention as in claim 30 and further comprising:

shock absorbing means mounted on said transfer means and located to contact said stop means and absorb the forces generated by the stopping of said transfer means.

32. The invention as in claim 31 and further comprising:

force resisting means for contacting said transfer means to resist the forces generated by the movement of said articles from said accumulating means and into said transfer means.

33. The invention as in claim 32 wherein said force resisting means comprise:

a rail fixedly mounted on said frame; and an opening extending through said transfer means and located to be in alignment with said rail so that said rail is located in said opening as said transfer means is moved by said second moving means.

34. The invention as in claim 1 wherein said transfer means comprise:

a pair of spaced apart support brackets;

at least a pair of support bars extending between and secured to said support brackets; and holding means for supporting said articles and maintaining them in upright positions as they are moved into and out of said transfer means.

35. The invention as in claim 34 wherein said transfer holding means comprise:

at least three circumferentially spaced apart brushes.

36. The invention as in claim 35 wherein:

at least two of said brushes are adjustably mounted for adjustment in radial directions.

37. The invention as in claim 1 wherein said holding means comprise:

upper holding means having an arcuate surface adapted to be moved into contact with a top portion of a partially closed compartment;

first vertical reciprocating means for reciprocating said upper holding means between an opened position and a closed position;

lower holding means having an arcuate surface forming a cradle to support said partially closed compartment;

second vertical reciprocating means for reciprocating said bottom member between an opened position and a closed position; and horizontal reciprocating means for reciprocating said upper and lower holding means between locations whereat a partially closed compartment is removed from said holding means and whereat said holding means are positioned around a partially closed compartment.

38. The invention as in claim 37 and further comprising:

said arcuate surface of said lower holding means having a plurality of spaced apart slots formed therein;

a plurality of fixed support fingers located in alignment with said slots so that at least one of said at least partially closed compartments is positioned on said support fingers when said lower holding means are moved to said opened position;

said arcuate surface of said lower holding means having a lowermost portion and each of said support fingers having a top surface; and said support fingers being located so that said top surfaces are slightly below said lowermost portion.

39. The invention as in claim 37 wherein said horizontal reciprocating means comprise:

at least a pair of spaced apart guide rails mounted on said frame;

slide members mounted on said guide rails for sliding movement thereover;

a support member extending between and secured to said slide members;

said second vertical reciprocating means mounted on said support member for movement therewith; and said first vertical reciprocating means mounted on said second vertical reciprocating means for movement therewith.

40. The invention as in claim 1 and further comprising:

a knife;

mounting means for mounting said knife for movement in reciprocating linear directions;

driving means for reciprocating said knife;

positioning means for positioning a widthwise extending joining means relative to said knife so that said knife will contact the centerline of said widthwise extending joining means to sever said widthwise extending joining means and the associated portion of said lengthwise extending joining means to separate one of said partially closed compartments; and support means for supporting said widthwise extending joining means and said associated portion of said lengthwise extending joining means to cooperate with said knife in the separation of said one of said partially closed compartments.

41. The invention as in claim 40 wherein said positioning means comprise:

a first inclined surface for supporting another of said partially closed compartments so that a force is applied to said another of said partially closed compartments tending to move it in one direction;

a second inclined surface for supporting one of said partially closed compartments so that a force is applied to said another and said one of said partially closed compartments tending to move them in said one direction; and mounting means for mounting said second inclined surface and said support means for movement in reciprocating linear directions between a severing location and a non-severing location.

42. The invention as in claim 41 wherein:

said first and second inclined surfaces each comprise a plurality of spaced apart fingers.

43. The invention as in claim 42 and further comprising:

support means for supporting said severed one of said partially closed compartments at a relatively fixed location.

44. The invention as in claim 43 and further comprising:

conveyor means for removing said severed partially closed compartment from said support means and conveying it to a palletizing station.

45. Apparatus for packaging a plurality of articles comprising:

base support means located at a relatively fixed location;

moving means for moving a continuous strip of material having a plurality of interconnected compartments each one having an open end through a plurality of work stations in a predetermined linear direction;

said interconnected open ended compartments comprising at least tow superposed sheets of a flexible material having opposite edge portions defining the width thereof and lengthwise and widthwise extending joining means for joining superposed portions of said at least two superposed sheets to form said open ended compartments;

said open ended compartments having parallel longitudinally extending horizontal axes extending in said widthwise direction and perpendicular to said predetermined linear direction;

said open ended compartments moving in the lengthwise direction with the open ends of said open ended compartments being located along one of said opposite edge portions;

opening means for moving the portions of said at least two superposed sheets of each open ended compartment in opposite directions to form a generally circular opening therein;

transfer means for holding a plurality of articles;

force applying means for applying a force on said plurality of articles to move said plurality of articles out of said transfer means, through said generally circular opening and into said at least one of said open ended compartments;

closing means for at least partially closing the portions of said at least two superposed sheets adjacent to said generally circular opening to form at least a partially closed compartment having said plurality of articles contained therein;

holding means for holding said at least a partially closed compartment;

said moving means moving said holding means to move said at least a partially closed compartment toward a third work station to form a plurality of interconnected partially closed compartments; and said movement of said at least a partially closed compartment also moving said continuous strip of material.

46. The invention as in claim 45 wherein said force applying means comprises:

a rodless cylinder;

an external yoke mounted for reciprocating sliding movement over said rodless cylinder; and a work performing tool mounted on said external yoke and located to contact at least the end one of said articles.

47. The invention as in claim 46 and further comprising:

mounting means for mounting said rodless cylinder on said base support means.

48. The invention as in claim 47 wherein said mounting means comprise:

a relatively rigid hollow support having opposite end portions and a longitudinal axis;

said rodless cylinder having opposite end portions;

support means at each of said opposite end portions for supporting said rodless cylinder;

an external guide rail mounted on said relatively rigid hollow support;

slidable bearing means mounted on said external guide rail for sliding movement thereover;

coupling means for coupling said slidable bearing means and said external yoke so that movement of said external yoke moves said slidable bearing means; and said work performing tool mounted on said slidable bearing means for movement therewith so that forces applied to said work performing tool will be absorbed by said slidable bearing means, said guide rail and said relatively rigid hollow support.

49. The invention as in claim 48 and further comprising:

said relatively rigid hollow support having a longitudinally extending slot formed therein; and at least a portion of said coupling means extending through said longitudinally extending slot.

50. The invention as in claim 49 wherein said coupling means comprise:

a bracket mounted on said external yoke and located so that at least a portion thereof extends through said longitudinally extending slot;

a plate member mounted on said slidable bearing means; and connecting means for connecting said bracket and said plate member together so that said plate member moves with said bracket.

51. The invention as in claim 50 wherein the connecting means comprise:

at least one weld.

52. The invention as in claim 45 and further comprising:

a plurality of accumulating means each of which accumulates a predetermined number of said articles;

said plurality of accumulating means having parallel longitudinal axes;

each of said plurality of accumulating means having discharging means for discharging said accumulated articles from each of said plurality of accumulating means;

said transfer means receiving and holding said discharged articles from each of said accumulating means and having a longitudinal axis;

second moving means for moving said transfer means in linear directions so that said longitudinal axis thereof is aligned with said longitudinal axis of one of said accumulating means when said accumulated articles are being received from said one of said accumulating means and for moving said transfer means so that said longitudinal axis of said transfer means is aligned with said generally circular opening; and conveyor means for conveying said plurality of interconnected partially closed compartments to a palletizing station.

* * * * *